US006161818A

United States Patent [19]

Medwin

[11] Patent Number: 6,161,818

[45] Date of Patent: Dec. 19, 2000

[54] SYSTEM FOR STRETCHING A CARPET

[75] Inventor: Steven Jay Medwin, Wilmington, Del.

[73] Assignee: E. I. du Pont de Nemours and Company, Wilmington, Del.

[21] Appl. No.: 09/287,431

[22] Filed: Apr. 7, 1999

Related U.S. Application Data

[62] Division of application No. 08/879,939, Jun. 20, 1997.

[51] Int. Cl.[7] ..... B25B 25/00

[52] U.S. Cl. ..... 254/200

[58] Field of Search ..... 254/200–212

[56] References Cited

U.S. PATENT DOCUMENTS

| | | | |
|---|---|---|---|
| 168,633 | 10/1875 | Goss | 254/200 |
| 298,521 | 5/1884 | Truslow | 254/209 |
| 329,136 | 10/1885 | Camp | 254/200 X |
| 448,992 | 3/1891 | Pool . | |
| 1,929,837 | 10/1933 | Cathcard | 254/205 |
| 1,952,218 | 3/1934 | Peterson | 254/200 |
| 2,326,117 | 8/1943 | Bartlow | 254/62 |
| 2,606,743 | 8/1952 | Owens | 254/62 |
| 3,022,979 | 2/1962 | Dahlke | 254/209 |
| 3,282,564 | 11/1966 | Weaver | 254/212 |
| 3,311,347 | 3/1967 | Thompson | 254/204 |
| 3,706,440 | 12/1972 | Ross | 254/62 |
| 3,747,157 | 7/1973 | Szymanski | 16/5 |
| 3,752,440 | 8/1973 | Ream | 254/62 |
| 3,791,624 | 2/1974 | Payson | 254/62 |
| 3,917,225 | 11/1975 | Payson | 254/60 |
| 3,945,609 | 3/1976 | Platek | 254/60 |
| 3,951,382 | 4/1976 | Asbury | 254/62 |
| 3,952,997 | 4/1976 | Whitlock | 254/63 |
| 3,963,216 | 6/1976 | Victor | 254/62 |
| 3,977,651 | 8/1976 | Chamberlain | 254/57 |
| 3,980,274 | 9/1976 | Ebert | 254/57 |
| 4,003,549 | 1/1977 | Sergerie | 254/60 |
| 4,008,879 | 2/1977 | Youngman | 254/57 |
| 4,042,211 | 8/1977 | Hammond et al. | 254/57 |
| 4,076,213 | 2/1978 | Payson | 254/60 |
| 4,084,787 | 4/1978 | Kowalczyk | 254/57 |
| 4,230,302 | 10/1980 | Crain, Jr. | 254/212 |
| 4,230,303 | 10/1980 | Schilz | 254/212 |
| 4,361,311 | 11/1982 | Koroyasu et al. | 254/200 |
| 4,394,004 | 7/1983 | Allen et al. | 254/404 |
| 4,509,725 | 4/1985 | Taiavera | 254/212 |
| 4,538,846 | 9/1985 | Alexander | 294/8.6 |
| 4,627,653 | 12/1986 | Koroyasu | 294/8.6 |
| 4,730,858 | 3/1988 | Humann | 294/8.6 |
| 4,772,058 | 9/1988 | Andersen | 294/8.6 |
| 4,815,708 | 3/1989 | Samson | 254/212 |
| 4,828,305 | 5/1989 | Gaddy | 294/8.6 |
| 4,934,658 | 6/1990 | Berg et al. | 254/212 |
| 4,949,604 | 8/1990 | Squires | 81/488 |
| 5,007,616 | 4/1991 | Scarpino | 254/212 |
| 5,145,225 | 9/1992 | Muller et al. | 294/8.6 |
| 5,150,884 | 9/1992 | Hyer et al. | 254/209 |
| 5,176,387 | 1/1993 | Taggart | 294/8.6 |
| 5,183,238 | 2/1993 | Sorensen | 254/209 |
| 5,228,660 | 7/1993 | Massicotte | 254/201 |
| 5,255,894 | 10/1993 | Guarneri | 254/200 |
| 5,269,576 | 12/1993 | Krebs et al. | 294/8.6 |
| 5,288,057 | 2/1994 | Listau | 254/212 |
| 5,364,143 | 11/1994 | Grady | 294/8.6 |
| 5,472,170 | 12/1995 | Anasson | 254/212 |
| 5,484,136 | 1/1996 | Lopes et al. | 254/200 |
| 5,681,031 | 10/1997 | Foley | 254/209 |

*Primary Examiner*—Donald P. Walsh
*Assistant Examiner*—Emmanuel M. Marcelo

[57] ABSTRACT

An apparatus and method for stretching a carpet includes the application of a downwardly directed actuation force on a foot-operated pedal actuator to generate a horizontally directed carpet stretching force. An extension arrangement included either fixed length and/or adjustable length truss members is used to anchor the carpet stretching apparatus.

11 Claims, 15 Drawing Sheets

SYSTEM FOR STRETCHING A CARPET

This is a division of application Ser. No. 08/879,939 filed Jun. 20, 1997, now pending.

BACKGROUND OF THE INVENTION

1. Field of the Invention

The present invention relates to a system for stretching a carpet.

2. Description of the Prior Art

It is the usual practice when laying wall-to-wall carpet (whether over a pad or directly over a floor) to attach a first edge of the carpet to the floor (usually, but not necessarily, adjacent to one wall of the room) and to unroll the carpet toward the opposite wall of the room. The carpet attachment may be effected using adhesive, or, as is perhaps more common, by laying the carpet over the upstanding spikes of a "tack strip" that is itself mounted adjacent to the wall. Before the other edge of the carpet is itself attached, it is necessary to stretch the carpet to eliminate wrinkles or creases in the carpet.

There are a variety of available devices that are used to stretch carpet. In one of the more common stretching devices, a "knee kicker", the stretching force necessary to stretch carpet is generated by impacting the knee of the installer against the device. As should be well-appreciated, the knee-kicker has ergonomic and medical disadvantages.

Other devices, so-called "power stretchers", include some form of linkage arrangement that converts a downward force applied to an operating lever into a generally horizontal stretching force imposed on a stretching head. The power stretcher involves the use of the operator's arms to apply the downward force to the lever. This is seen as preferable over the knee kicker inasmuch as the stretch is imparted to the carpet more slowly. Although the use of a power stretcher by an operator eliminates the more physical aspects of the kicker, it is required that a power stretcher be operated from a kneeling position. This has certain ergonomic disadvantages.

Accordingly, in view of the foregoing, it is believed to be advantageous to provide a system for stretching carpet that permits the operator to work from a standing position. Such a system is believed to avoid the ergonomic disadvantages associated with prior art stretching apparatus.

In order for the displacement of a carpet gripping head from the retracted to the extended position to impart a stretching action to the carpet the stretching apparatus must be anchored at a predetermined reference location with respect to the floor F. Only when so anchored and braced will a horizontal stretching force be imposed into the carpet C to stretch the same with respect to the floor F.

In the usual instance an abutment surface that lies behind the stretching apparatus is used to anchor the stretching apparatus in position. The abutment surface in such cases is usually defined either by the baseboard of a distant wall or by a gripping cleat, known as a "dead man", that is secured to the carpet behind the stretching apparatus. Since the abutment surface is usually disposed some distance behind the stretching apparatus it is conventional practice to utilize an extension arrangement to bridge the distance between the stretching apparatus and the abutment surface. A "dead man" is a gripping cleat that is typically fabricated using a plank of stock lumber onto the undersurface of which is attached a plurality of tack strips. The tack strips usually extend in the axial direction of the plank, with the spikes of the tack strip extending into the carpet when the undersurface of the "dead man" is laid on the carpet.

Current extension arrangements utilize one or more tubular extension members interconnectible with each other to bridge the distance from the stretching apparatus to the abutment surface. A tubular extension member may be either a predetermined fixed axial length or an adjustable axial length. The tubular extension members of the prior art are fabricated of a thick gauge metal material, and are rather massive and are, therefore, heavy and cumbersome.

The form of gripping cleat known as the "dead man" has a tendency to roll from its engagement with the carpet. The usual expedient used to prevent this occurrence is to require another operator physically stand on the "dead man" and to hold it in place during use. This necessity is seen as economically unattractive.

It is believed advantageous to provide an extension arrangement that is more lightweight and, accordingly, easier to handle. It is also believed to be advantageous to provide a gripping cleat which eliminates the requirement of any additional expedient to hold it in place in the carpet during use.

SUMMARY OF THE INVENTION

In a first aspect the present invention is directed to an apparatus for stretching a carpet disposed on a floor including a collar having an upstanding mast attached thereto with a boom being received within the collar. The boom has a carpet-gripping head at an end thereof. The boom is slidable with respect to the collar to displace the head from a retracted to an extended position. In the retracted position the head is within a first predetermined distance of the collar. A sail member is rigidly attached to the boom, the sail member having a cam surface thereon. The cam surface has an upper, curved (preferably circular) portion and a lower, linear, portion thereon. A foot-operable pedal is slidably mounted to the mast. The pedal has a cam follower thereon that is advanceable along the cam surface as the pedal displaces downwardly in response to a vertically downwardly directed force imposed thereon. In response to the vertically downwardly directed force the boom advances with respect to the collar to displace the head from the retracted position to the extended position. In the extended position the head is spaced a second distance from the collar, the second distance being greater than the first distance. The carpet stretching apparatus further includes an anchor arrangement for positioning the collar at a predetermined reference location with respect to the floor, so that as the head displaces from the retracted position to the extended position a stretching force is imposed on the carpet to stretch the carpet with respect to the floor.

In another aspect the present invention is directed to an extension system connectible to the carpet stretching apparatus for use therewith. The extension system comprises an extender piece having at least three tubular rod members rigidly connected to each other by struts to form a truss structure. The struts connecting any two of the tubular rod members lie substantially in the plane containing the two tubular rod members. The tubular rod members are supported by the struts in a disposition radially spaced from the axis and in parallel relationship to each other and to the axis.

An extender piece in accordance with this aspect of the invention may be either fixed axial length or an adjustable length. Two extender pieces (either of fixed and/or adjustable length) may be interconnected with each other using a latching arrangement in accordance with the present invention. In the fixed length extender a first end of each of the tubular members forming this extender piece has a latch recess therein, while the second end of each of the tubular members forming this extender piece has a catch thereon. In the case of the adjustable length extender a first end of each of the tubular members forming the extender piece may have either the latch recess or the catch thereon. In either event, in the preferred instance the latch recess is formed in a latch bar pivotally mounted to each of the tubular rod members forming the extender piece. A release membrane may be connected to each of the latch bars in such a way that displacement of the release membrane causes each of the latch bars to displace pivotally with respect to the tubular rod member to which the latch bar is mounted. This simultaneously releases each catch from the recesses in which it is reposed.

The adjustable length extender piece includes an outer support tube supported in substantially rigid relationship from the tubular rod members adjacent to the first end of the extender piece and an elongated inner tube slidably disposed within the outer support tube in a direction parallel to the axis of the truss structure so as to be telescopically receivable within the truss structure. The elongated inner tube is securable in fixed relationship to the outer support tube at any of a predetermined plurality axial locations along the elongated inner tube thereby to adjust the distance from the free end of the elongated inner tube to the second end of the extender piece.

In still another aspect the present invention is directed to a process for stretching carpet comprising the steps of anchoring a carpet stretching apparatus at a first predetermined location with respect to the carpet, gripping the carpet at a second location spaced from the first location with a gripping head, and, from a standing position, imposing a substantially downwardly directed force on a foot-operated pedal actuator associated with the gripping head to displace the gripping head from a retracted position to an extended position, thereby to impose a force on the carpet causing the same to be stretched over the floor.

BRIEF DESCRIPTION OF THE DRAWING

The invention will be more fully understood from the following detailed description, taken in connection with the accompanying drawings, in which:

FIG. 13 is a side elevational view of an adapter for interconnecting the extension arrangement to an anchor apparatus; and, FIG. 14 is a perspective view of an anchor arrangement in accordance with various aspects of the present invention, while

DETAILED DESCRIPTION OF THE INVENTION

Figure 1:
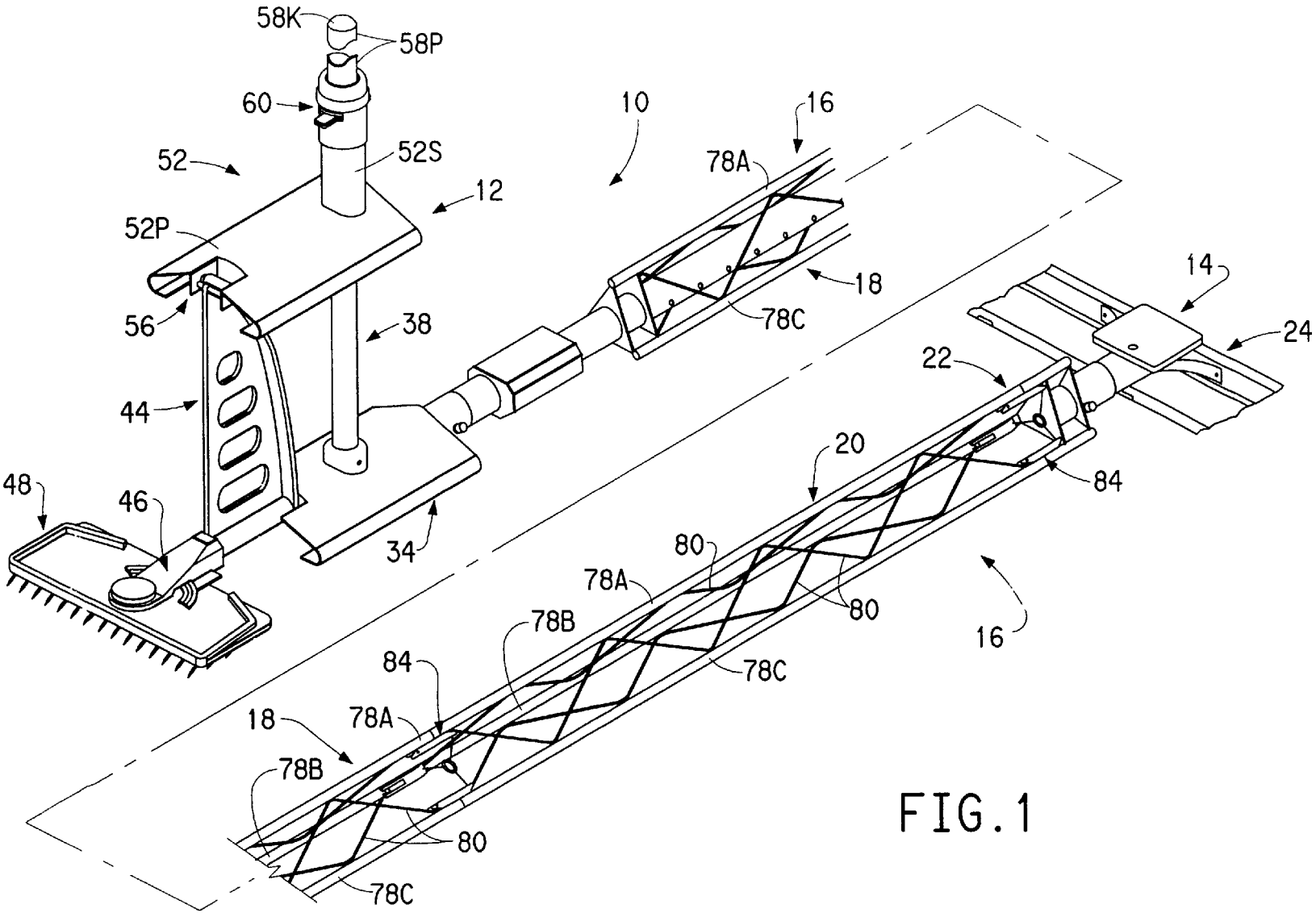
FIG. 1 is a front perspective view of a system for stretching an installed carpet in accordance with various aspects of the present invention.

Throughout the following detailed description, similar reference numerals refer to similar elements in all Figures of the drawings.

FIG. 1 illustrates a front perspective view of a system generally indicated by the reference character 10 for stretching an installed carpet which includes various aspects of the present invention. As will be developed the system 10 is useful for stretching a carpet C (FIG. 3) with respect to a floor surface F (FIG. 3) over which the carpet C is laid. A carpet pad P (FIG. 3) may be disposed between the carpet C and the floor surface F.

The carpet stretching system 10 includes a carpet stretching apparatus generally indicated by the reference character 12, an anchor arrangement generally indicated by the reference character 14 (portions of which are broken-away for clarity), and an extension arrangement generally indicated by the reference character 16 for interconnecting the stretching apparatus 12 with the anchor arrangement 14. The extension arrangement 16 includes at least one adjustable extender piece 18, and/or one or more fixed length extender piece(s) 20, and an adapter 22 for joining the extension arrangement 16 to the anchor arrangement 14. The anchor arrangement 14 may take the form of a cleat 24 that grips securely into the carpet behind the stretching apparatus 12 to provide a backstop against which the stretching apparatus 12 may be braced so that forces generated by the stretching apparatus 12 may be imparted into the carpet C. Each of these aspects of the carpet stretching system 10 will be discussed herein.

Carpet Stretching Apparatus

Figure 2:
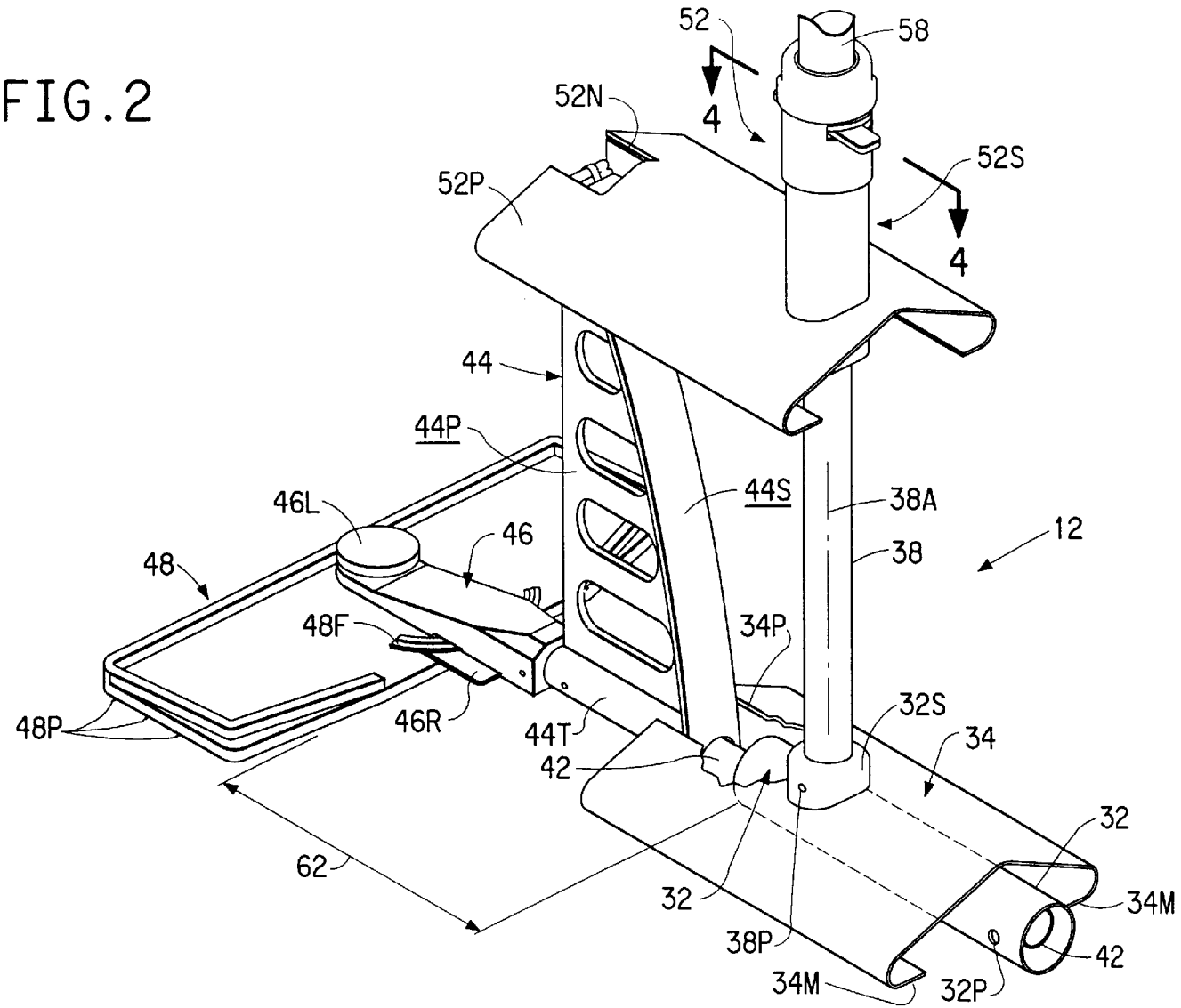
FIG. 2 is a rear perspective view, with portions broken away for clarity, of a carpet stretching apparatus that forms part of the carpet installation system of FIG. 1 with the gripping head of the carpet stretching apparatus being shown in the retracted position.
Figure 3:
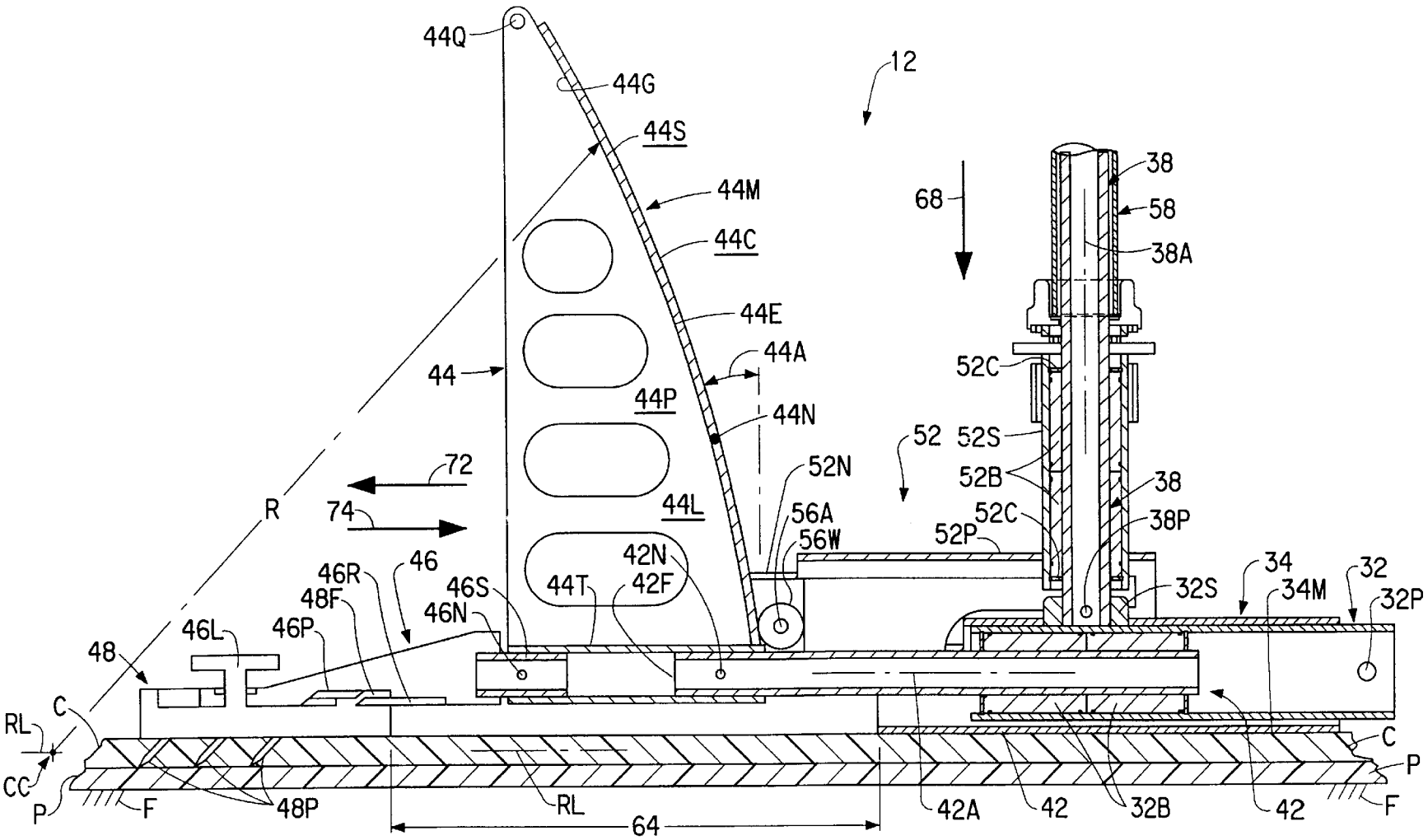
FIG. 3 is a side elevational view taken partially in section of the carpet stretching apparatus of FIG. 2 with the gripping head thereof being shown in the extended position.

The structural details of the carpet stretching apparatus 12 may be more fully appreciated by particular reference to FIGS. 2 and 3.

The carpet stretching apparatus 12 includes a hollow tubular collar 32 having a socket 32S formed on its exterior surface. The collar 32 is fabricated from machined steel. The longitudinal bore of the collar 32 is lined with bearings 32B (FIG. 3), such as a linear ball bushing sold by Thompson Industries, Inc., Port Washington, N.Y., as model SSU-16-W. A detent opening 32P is formed in the collar adjacent to the trailing end.

A tent-like cover 34 overlies the collar 32 over substantially its entire axial length. The center region of the cover 34 forms a foot rest for a purpose to be described. The cover 34 is formed from a substantially rigid sheet of steel. A portion 34P (FIG. 2) along the forward end of the cover 34 is removed to provide clearance for movement of other parts of the apparatus 12, as will be described. The lateral margins 34M (FIG. 2) of the cover 34 are turned under, thereby to define support feet that parallel the collar 32 and impart stability to the apparatus 12. A portion of the cover 34 adjacent to the forward end thereof is broken away for clarity of illustration.

A generally tubular upstanding mast 38 is rigidly attached to the collar 32. The lower end of the mast 38 is received in the socket 32S and secured into engagement with the collar 32 using a pin 38P. The mast 38, which has a reference axis 38A extending therethrough, is preferably formed of a case hardened steel material.

A boom 42 is telescopically received within the collar 32. The boom 42 is reciprocally slidable with respect to the collar 32 on the bearing 32B. The boom 42 is a generally tubular member fabricated of a case hardened steel material. The boom 42 has a reference axis 42A extending therethrough. Preferably the boom 42 is implemented as a linear bearing race compatible for use with the bearings 32B on which the boom 42 rides. Suitable for use as the boom 42 is a linear bearing race such as that manufactured by Thompson Industries, Inc., Port Washington, N.Y., as model LRL-16.

A sail member 44 is rigidly secured to the forward end 42F of the boom 42. The sail member 44 includes a hollow mounting tube 44T to which an upstanding plate 44P is welded. Cut-outs are provided in the plate 44P to minimize the weight thereof. The interconnection between the mounting tube 44T and the boom 42 is effected by a rolled pin 42N. In some instances it may be desirable to fabricate the sail 44 as a cast member (as from aluminum), in which event the tube 44T and the plate 44P are integrally formed with each other.

The forward end of the mounting tube 44T accepts a stub shaft 46S trailing from a handle 46. The interconnection between the mounting tube 44T and the stub shaft 46S is effected by a rolled pin 46N. The handle 46 is attached, via a lock nut 46L, to a carpet-gripping head 48. The undersurface of the carpet gripping head 48 carries an array of gripping pins 48P. The pins 48P penetrate into the material of the carpet C. The pins 48P are angled forwardly with respect to the vertical to transfer a stretching force into the carpet, in the well-understood manner. The upper surface of the head 48 includes a flange 48F that projects into a pocket 46P formed in the underside of the handle 46. The flange 48F is held in the pocket 46P by a retaining plate 46R.

The gripping head 48 may be angularly adjusted to any position within an angular range 48R (FIG. 4) with respect to the axis 42A of the boom 42 in a plane parallel to the floor F. Suitable for use as the gripping head 48 is the swivel head sold by Roberts Consolidated Industries, Inc., City of Industry, Calif., as the Roberts Power Stretcher, GT Power-Lok stretcher, part number 10-254, or a nap grip head such as sold as part number 10-248.

A cam member 44M is welded or otherwise suitably attached to the edge 44E of the support plate 44P of the sail 44. The exterior of the cam member 44M defines a cam surface 44S while the interior surface of the cam member 44M serves as a guide surface 44G, as will be described. The cam surface 44S includes an curved portion 44C that melds seamlessly with a generally linear portion 44L at a transition point 44N. The curved portion 44C extends along substantially two-thirds of the arcuate length of the cam member 44M, while the linear portion 44L is disposed over the lower third adjacent to the mounting tube 44T. The linear portion 44L extends along the tangent to the curved portion 44C at the transition point 44N. The linear portion 44L is inclined at a slight angle 44A with respect to the axis 42A of the boom 42. A removable actuator stop 44Q is provided at the apex of the plate 44P.

Figure 5:
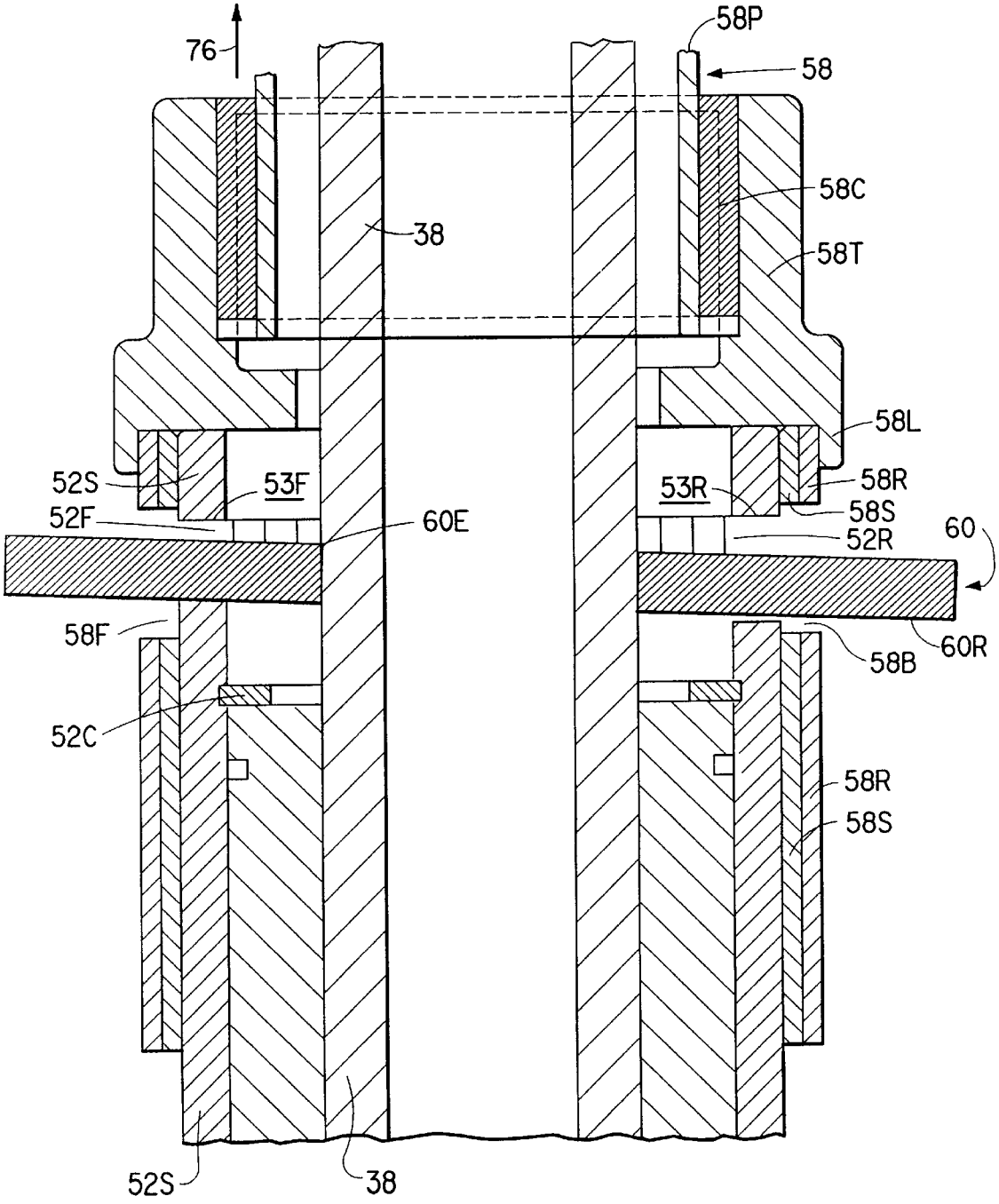
FIG. 5 is an enlarged side sectional view showing a locking arrangement used in the carpet stretching apparatus when in the locked position for preventing relative upward movement of the lifting handle with respect to the mast.

The stretching apparatus 10 further includes a foot-operated actuator assembly generally indicated by the reference character 52. The actuator assembly 52 is received for reciprocal slidable motion along the exterior of the mast 38. The actuator assembly 52 includes a hollow bearing support tube 52S that has bearings 52B (FIG. 3), similar to the bearings 32B, received on the interior thereof. The bearings 52B are secured at the desired axial position within the support tube 52S by retainer rings 52C (FIG. 5). The retainer rings 52C are each received in a groove formed on the inner surface of the bearing support tube 52S for that purpose. The same bearings as are used for the collar bearings 32B may be used to implement the bearings 52B for the actuator. Likewise, the mast 38 is also preferably implemented using a bearing race similar to the bearing race that is used to form the boom 42.

As is perhaps best seen in FIG. 5 forward and rear circumferentially extending slots 52F, 52R, respectively, are formed through the support tube 52S adjacent to its upper end (above the upper retainer ring 52C), for a purpose to be described. The axial extent of the forward slot 52F (i.e., measured along the length of the support tube 52S) is less than the axial extent of the rear slot 52R. The upper boundaries of the slots 52F, 52R define forward and rear upper sill surfaces 53F, 53R, respectively.

Figure 4:
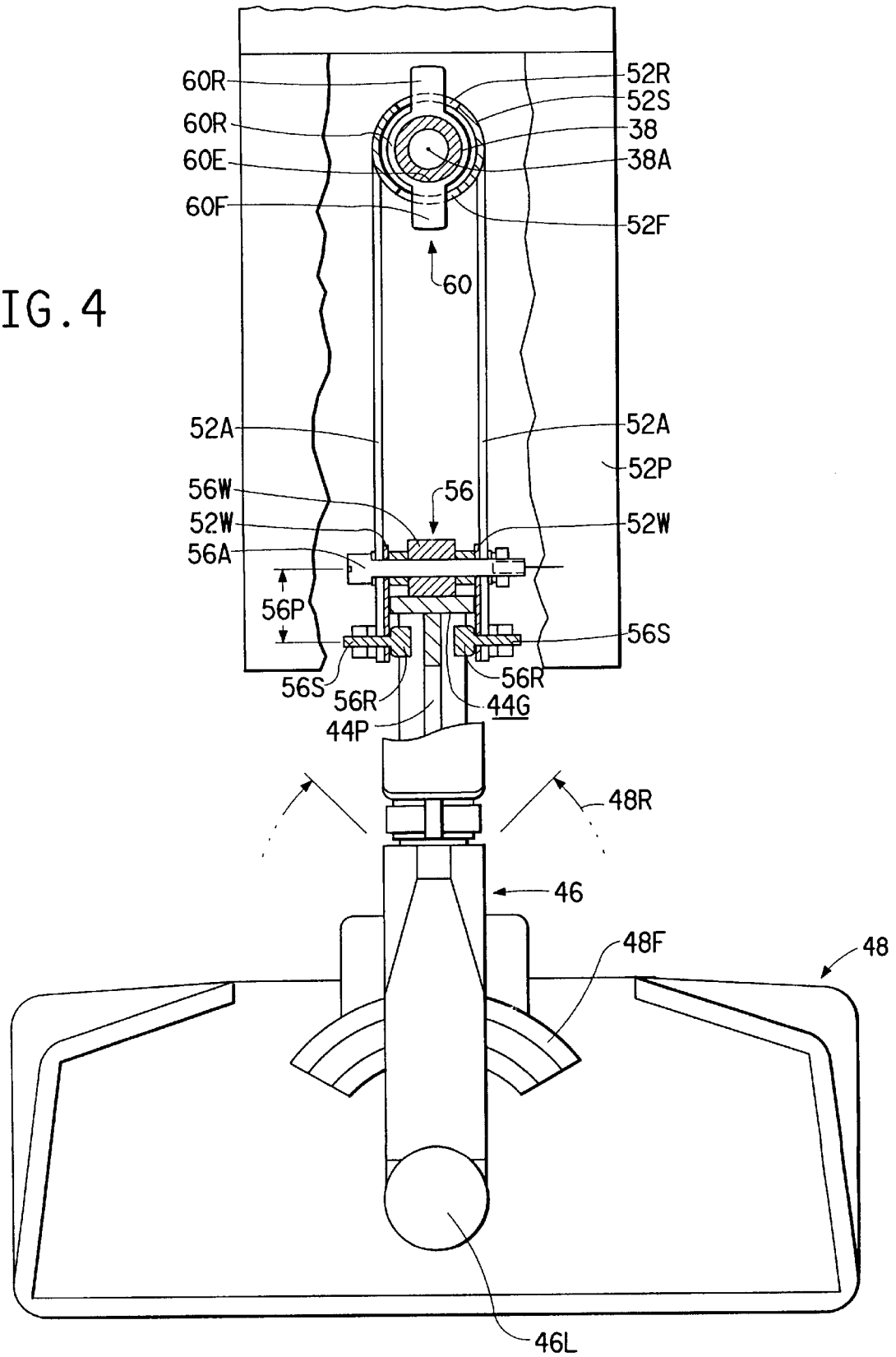
FIG. 4 is a sectional view taken along section lines 4—4 in FIG. 2 showing the cam follower arrangement used in the carpet stretching apparatus there shown.

In FIG. 4 may be seen a pair of spaced arms 52A that extend in parallel relationship from the bearing support tube 52S adjacent to the lower end thereof. The confronting inside surfaces of each of the arms 52A carry a wear surface 52W thereon. A cam follower arrangement generally indicated at reference character 56 is attached to the free ends of the arms 52A in the vicinity of the wear surfaces 52W. The cam follower arrangement 56 brackets the cam member 44C mounted to the sail 44.

The cam follower arrangement 56 includes a follower wheel 56W that is supported on an axle 56A. The axle 56A is set back a predetermined distance from the free ends of the arms and extends between the inside surfaces of the arms 52A. The follower wheel 56W rides on the cam surface 44S during the downward assertion stroke of the actuator 52, as will be described. Each of the arms 52A has a guide roller 56R supported on a stub shaft 56S. Each stub shaft 56S disposed in next adjacency to the free end of the 52A on which it is mounted. The guide rollers 56R ride against the guide surface 44G of the cam member 44C during substantially all of the upward return stroke of the actuator 52. The span 56P between the axle 56A of the follower wheel 56 and the stub shafts 56S of the guide rollers 56R is sized such that, at the top of the actuating stroke (the position illustrated in FIG. 2) the follower wheel 56 contacts the camming surface 44S while the guide rollers 56R contact the guide surface 44G of the cam member 44C.

A cover, or pedal, 52P is mounted to the exterior of the bearing support tube 52S and extends radially outwardly therefrom. The cover 52P overlies substantially the full length of the actuator assembly 52. The cover serves as an actuating pedal for the stretching apparatus 12. A notch 52N (FIGS. 2 and 3), formed in the forward edge of the cover 52P, accommodates the cam member 44M as the pedal 52P is depressed.

Figure 6:
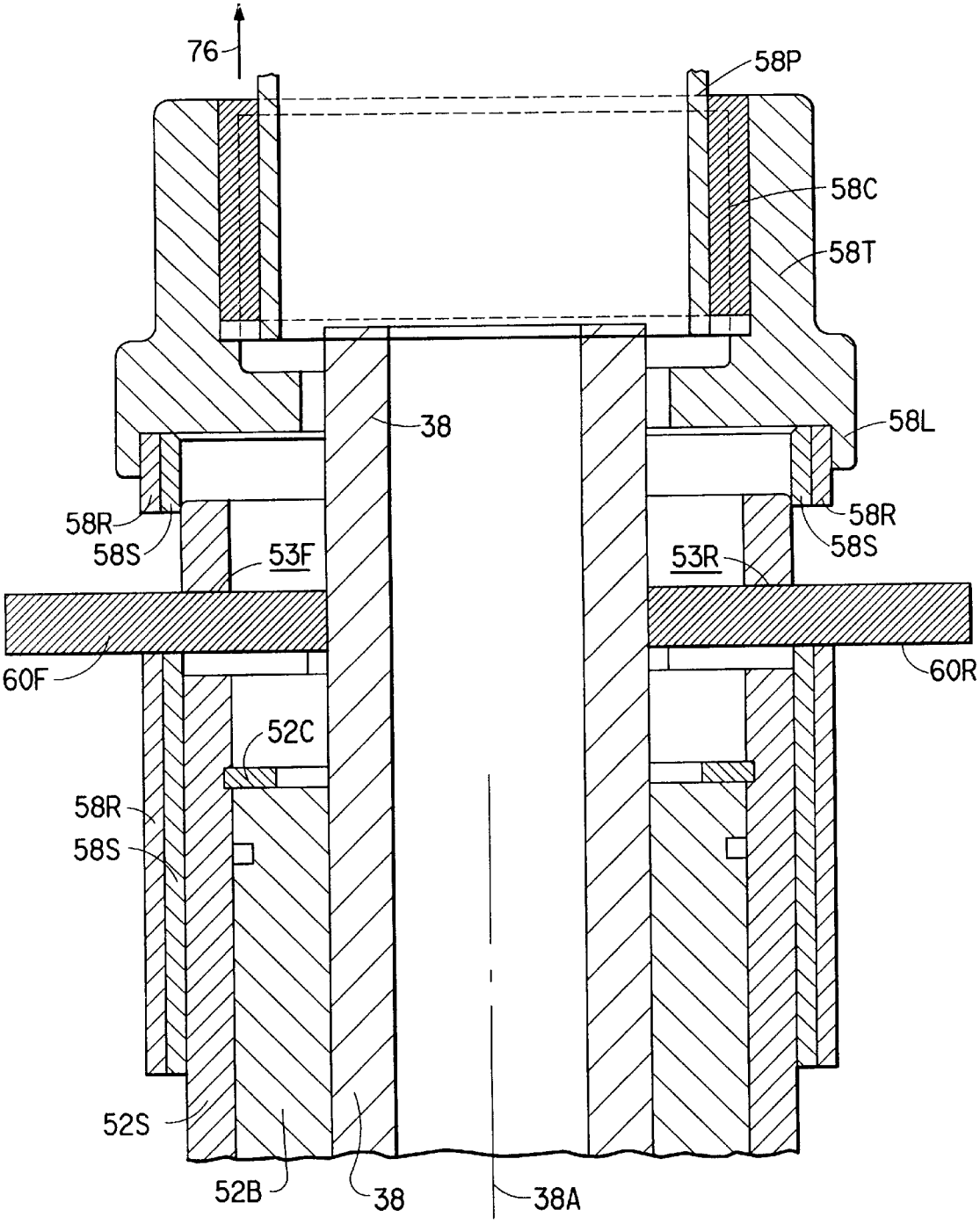
FIG. 6 is a side sectional view similar to FIG. 5 showing the locking arrangement in the unlocked position permitting relative upward movement of the lifting handle with respect to the mast.
Figure 7:
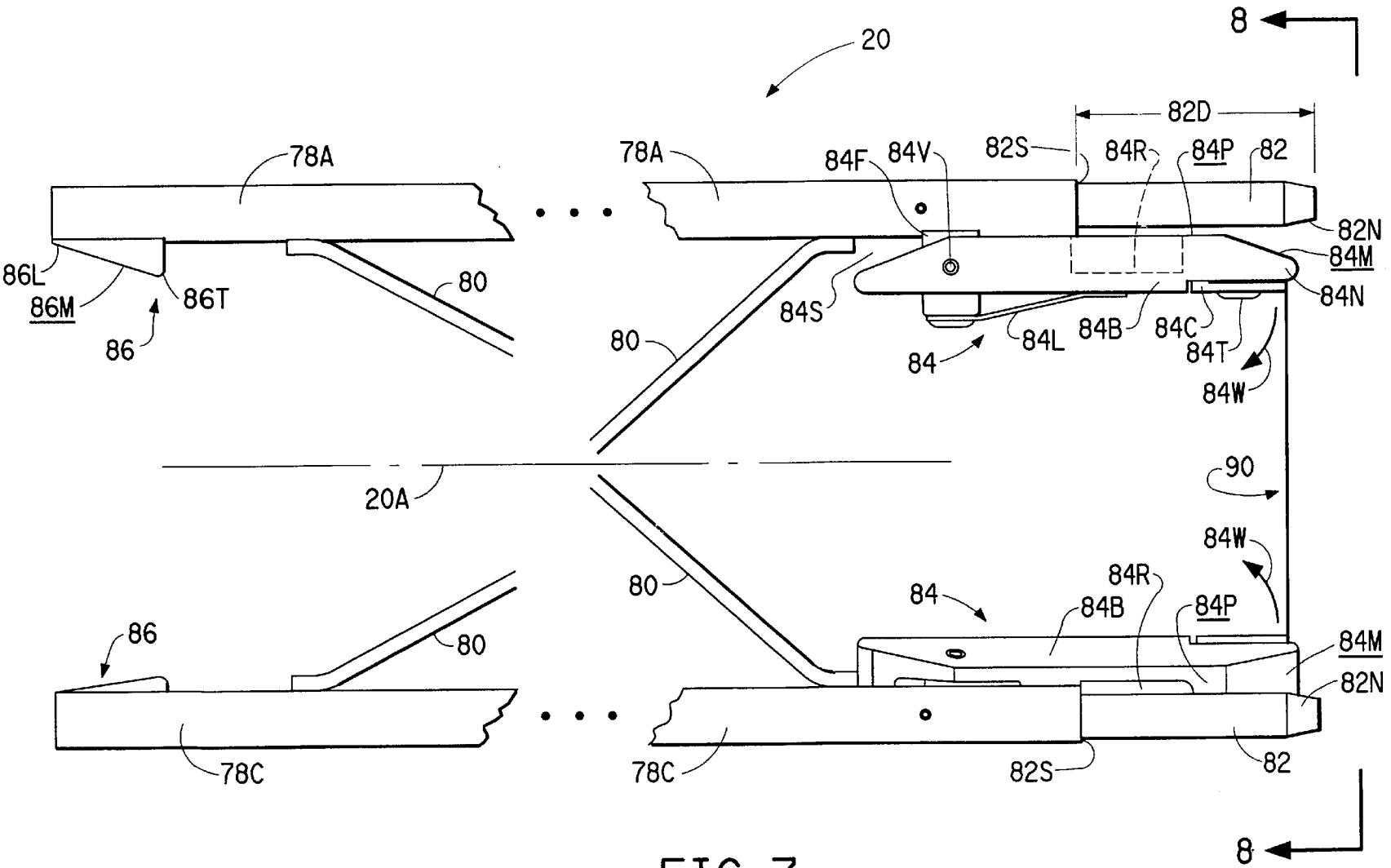
FIG. 7 is a side elevation view of the region adjacent each axial end of a fixed length extender piece used in the extension arrangement in accordance with another aspect of the present invention.

The stretching apparatus 12 includes an operating handle generally indicated by the reference character 58. As should be understood from FIGS. 3, 5 and 6 the operating handle 58 is formed from an elongated, hollow, ornamental post 58P. The post 58P accepts a rounded cap 58K (FIG. 1) at its upper end. The lower axial end of the post 58P is welded to an externally threaded collar 58C. The collar 58C is threaded into a fitting 58T that has a depending lip 58L at its lower end. The inside surface of the lip 58L is connected to a latch riser 58R. The inside surface of the riser 58R is lined with a low friction sleeve 58S.

The riser 58R and the sleeve 58S are each provided with forward and rear slots. The slots in the riser 58R and the sleeve 58S have the same axial dimension and thereby register to define respective radially extending forward and rear windows 58F, 58B. In the assembled relationship shown in FIGS. 5 and 6 the sleeve 58S and riser 58R slip over the exterior surface of the upper end of the support tube 52S such that the forward and rear windows 58F, 58B respectively align with the forward and rear slots 52F, 52R in the support tube 52S.

The inside diameter of the post 58P is sized such that the mast 38, which extends centrally and axially through the bearing 52B, may project in telescopic relationship into the interior of the post. Moreover, the inside diameter of the sleeve 58S is sized such that it may axially overlap the exterior surface of the support tube 52S. As a result of such relationships, it may be appreciated that as the support tube 52S rides downwardly along the exterior of the mast 38 the telescopic reception of the mast 38 into the interior of the handle 58 permits the handle 58 to move simultaneously downwardly with the tube 52S. However, since the handle 58 is also relatively movable with respect to the support tube 52S along the interface defined between the outside surface of the upper end of the tube 52S and the inside surface of the sleeve 58S, the handle 58 may move upwardly independently of the support tube 52S.

A locking mechanism generally indicated by the reference character 60. As is seen from FIG. 4 the locking mechanism includes a generally planar latch member having an annular central ring 60R from which two diametrically opposed tabs 60F, 60R extend radially outwardly. The inside surface of the ring 60R terminates in a sharp annular locking edge 60E. The latch member is mounted within the stretching apparatus 12 such that the mast 38 extends through the central ring 60R while the tabs 60F, 60R are captured by and extend radially through the forward and rear slots 52F, 52R in the support tube 52S and the respective forward and rear windows 58F, 58R registered therewith. The diameter of the central ring portion 60R is close to (i.e., within several thousandths of an inch) the diameter of the mast 38.

Since the axial extent of the rear slot 52R is greater than that of the forward slot 52F the latch member inclines with respect to the axis 38A of the mast 38. This inclination brings the locking edge 60E along some angular extent of the ring 60R into contact with the surface of the mast 38. The locking edge 60E of the ring 60R slides along the surface of the mast 38 as the support tube 52S moves downwardly with respect thereto. However, relative upward movement of the support tube 52S with respect to the mast 38 is prevented by the biting engagement of the locking edge 60E into the mast 38. It may thus be appreciated that the locking mechanism 60 permits unimpeded downward motion of the support tube 52S along the exterior of the mast 38. However, unless the lock mechanism 60 is released, in a manner to be described, relative upward motion between the support tube 52S and the mast 38 is prevented.

To assemble of the apparatus 12 it is necessary that the actuator stop 44Q on the plate 44P be removed. The handle 58 and the support tube 52S are positioned with respect to each other such that the locking mechanism 60M may be inserted through the registered slots 52F, 52R and windows 58F, 58R. This captured the central ring 60R within the support tube 52S. The handle/actuator assembly is thereafter lowered over the upper end of the mast 38 such that mast 38 projects through the central ring 60R. When the follower wheel 56W and the guide rollers 56G are brought into their respective positions with respect to the cam member 44M, the stop 44Q is re-inserted into the plate 44P.

Having set forth the structural details of the stretching apparatus 12 its operation may now be described. Owing to the presence of the bearing 32B the boom 42 is slidably movable with respect to the collar 32. In operation, the motion of the boom 42 with respect to the collar 32 displaces the head 48 from a retracted position (shown in FIG. 2) to an extended position (shown in FIG. 3). In the retracted position the head 48 is disposed within a first predetermined distance 62 (FIG. 2) from the collar 12. In the extended position (FIG. 3) the head 48 is spaced a second predetermined distance 64 from the collar 32. As seen by comparison of FIG. 2 with FIG. 3 the second distance 64 is greater than the first distance 62.

The displacement of the head 48 from the retracted to the extended positions is caused by the conversion of a substantially vertically directed actuating force (a force acting in the direction of the arrow 68, FIG. 3) into a horizontally directed displacing force (a force acting in the direction of arrow 72 that is parallel to the plane of the floor F). In accordance with the present invention the vertically downwardly directed force 68 is imposed by an operator on the pedal 52P of the actuator assembly 52. This mode of actuation is more ergonomically advantageous than that required by prior art stretching apparatus. The imposition of the downward force causes the actuator assembly 52 to displace vertically along the mast 38 on the interface defined by the bearing 52B. As the actuator assembly 52 moves downwardly along the mast 38 the follower wheel 56W (FIG. 4) advances along the cam surface 44S. By virtue of the rigid interconnection between the sail 44 and the boom 42 advancement of the follower wheel 56W along the cam surface 44S is converted into the horizontally directed force 72. The horizontal force 72 causes the boom 42 to displace rectilinearly with respect to the collar 32 (on the interface defined by the bearing 32B). The displacement of the boom 42 displaces the head 48 to displace from the retracted to the extended positions. The head 48 reaches its fully extended position when the pedal 52P is located above the cover 34, as is best illustrated in FIG. 3.

The overall length and shape of the cam surface 44S is a result of compromise among various competing operational considerations. Given a desired linear magnitude of the stroke of the boom 42 (i.e., the distance between the retracted and extended positions) a decision may be made as to the height at which the pedal is to lie above the floor. The primary determinant of this height is perhaps the expected ease with which the foot of an operator may access the pedal. The radius of curvature of the curved portion 44C and the length and angular inclination of the linear portion 44L of the cam surface 44C are trade-offs between the mechanical advantage needed over various portions of the actuating stroke. Entering in this evaluation is the realization that a lesser mechanical advantage may be sufficient at the beginning of the downward stroke than at the end of the stroke (owing to the relative magnitude of the force necessary to begin stretching of a carpet as compared to incrementally increasing the degree of stretch in a carpet). With these factors taken into account it has been found that an acceptable camming surface 44S may be defined using a curved portion 44C with a circular contour centered on a center of curvature CC (FIG. 3) that lies at a Radius on the order of twenty-seven (27) inches. The center of curvature CC lies on a Reference Line RL (FIG. 3) that is one (1) inch below and parallel to the axis 42A of the boom 42. The linear portion 44L is inclined on the order of ten (10) degrees (the angle 44A) from the vertical and has a length on the order of four (4) inches (measured from the transition point 44N to the Reference Line RL. The linear portion 44L maintains a constant mechanical advantage through the lower portion of the actuation stroke. It should be appreciated that the use of a cam surface 44 having one (or more) appropriately shaped curved portion(s) and/or one (or more) appropriately sized linear portion(s) permits the mechanical advantage of the stretching apparatus to be tailored and optimized for the entire actuation stroke.

As noted earlier, the locking mechanism 60 is arranged to permit unimpeded downward motion of the support tube 52S along the exterior of the mast 38. Relative upward movement of the support tube 52S with respect to the mast 38 is prevented by the engagement of the locking edge 60E into the mast 38. The downward motion of the pedal actuator 52P may be stopped at any intermediate position along the mast 38. The locking mechanism 60 holds the actuator 52P in that location, even in the face of a restoring force acting in the direction 74 (counter to the direction of the force 72) imposed by the stretched carpet to the head 48.

The locking mechanism 60 may be released at any time to permit relative upward motion between the support tube 52S and the mast 38 to occur. The release of the locking mechanism may be fully understood with reference to FIGS. 5 and 6. To release the lock 60 an upwardly directed release force (i.e., a force acting in the direction of the arrow 76) imposed on the post 58P brings the upper axial ends of both the latch riser 58R and the sleeve 58S to which it is attached against the undersurface of the tab 60R. This lifts the lock member 60M into a substantially horizontal disposition (i.e., perpendicular to the axis 38A) and removes the edge 60E from its engagement with the mast 38. As the post 58P continues to be lifted, the upper surface of each of the tabs 60F, 60R is brought into abutting contact with the upper sill surfaces 53F, 53R, respectively on the bearing support tube 52S. Once the tabs 60F, 60R on the lock member 60M are pinched between the bearing support tube 52S and the riser 58R and the sleeve 58S, continued upward force on the post 58P lifts the support tube 52S (and the remainder of the actuator 52) with respect to the mast 38. As the post 58P is lifted, the guide rollers 56R contact the guide surface 44G of the cam member 44C throughout substantially the entire return stroke.

Process

It should be appreciated from the foregoing that hereinbefore described is a process for stretching carpet from the standing position. First, the stretching apparatus is anchored at a first predetermined location with respect to the carpet. The carpet is then gripped at a second, spaced, location by the gripping head 48. From a standing position a substantially downwardly directed force is applied to the foot-operated pedal actuator 52P associated with the gripping head 48. As the pedal actuator 52P moves the pedal along the path of travel 50 defined by the cam surface 44S. The gripping head 48 is thus displaced from a retracted position to an extended position, thereby to impose a force on the carpet causing the same to be stretched over the floor.

ANCHOR ARRANGEMENT AND EXTENSION ARRANGEMENT

In order for the displacement of the head 48 from the retracted to the extended position to impart a stretching action to the carpet C the stretching apparatus 12 must be anchored at a predetermined reference location with respect to the floor F. Only when so anchored and braced will displacement of the head 48 impose a horizontal stretching force (acting in the direction of the arrow 72) to the carpet C to stretch the same with respect to the floor F.

In most instances in the prior art an abutment surface that lies behind the stretching apparatus is used to anchor the stretching apparatus in position. The abutment surface in such cases is usually defined either by the baseboard of a distant wall or by a gripping cleat, known as a "dead man", that is secured to the carpet C behind the stretching apparatus. Since the abutment surface is usually disposed some distance behind the stretching apparatus it is conventional practice to utilize an extension arrangement to bridge the distance between the stretching apparatus and the abutment surface.

It should also be mentioned that an anchor arrangement is known in the art whereby a stretching apparatus may be anchored against a tackless strip disposed forwardly of the stretching apparatus. Such an anchor arrangement takes the form of a blade-like member connected to and extending forwardly from the stretching apparatus. Representative of such an arrangement is the device shown in U.S. Pat. No. 3,963,216 (Victor), in U.S. Pat. No. 3,980,274 (Ebert), in U.S. Pat. No. 4,084,787 (Kowalczyk), and in U.S. Pat. No. 5,288,057 (Listau). It should be understood that the stretching apparatus as disclosed and claimed herein may be appropriately modified to accept such an anchor arrangement and still remain within the contemplation of the present invention.

Fixed Length Extender Piece

With reference to FIG. 1 and to FIGS. 7 through 9E shown is the structure of a fixed length extender piece 20 used in the extension arrangement 16 of the present invention. The fixed length extender piece 20 has an axis 20A extending therethrough. The fixed length extender piece 20 is comprised of at least three tubular rod members 78A, 78B, 78C rigidly connected to each other by struts 80 to form a truss structure. As seen from FIGS. 1 and 8 the tubular rod members 78A, 78B, 78C are spaced equal radial distances from the central axis 20A and are supported in parallel relationship to each other and to the axis 20A by the wire struts 80. In the preferred construction a pin 82 projects a predetermined distance 82D (FIG. 7)from a first axial end of each of the tubular rod members 78A, 78B, 78C. The pin has a tapered nose 82N thereon. The end face of each rod member 78 defines an annular shoulder 82S at the base of the pin 82.

Figure 8:
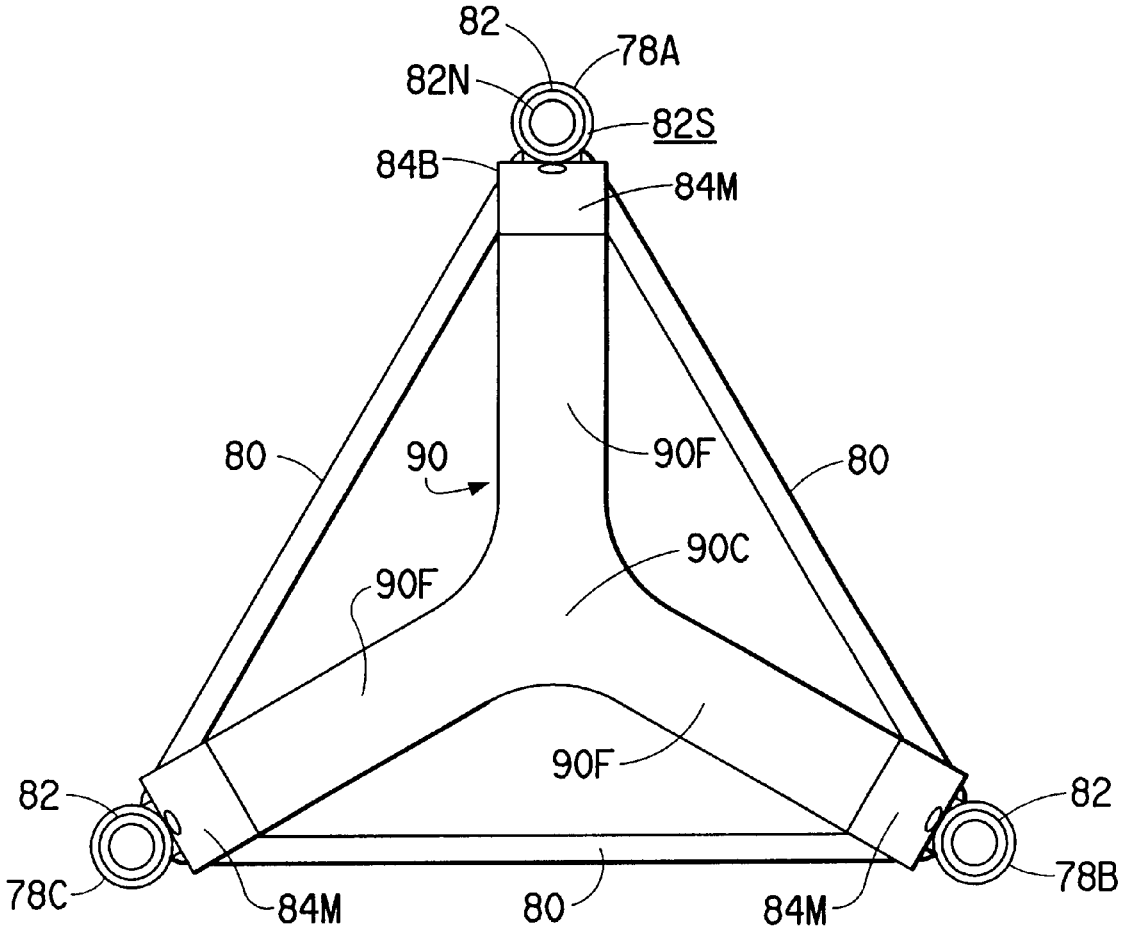
FIG. 8 is a elevation view taken along view lines 8—8 of FIG. 7 showing the release membrane used with both fixed length and variable extender pieces in the extension arrangement in accordance with the present invention.

As is clearly illustrated in FIG. 8 the struts 80 connecting any two of the tubular rod members 78A–78B, 78B–78C, or 78A–78C lie substantially in a plane containing the two tubular members. The struts 80 are preferably implemented using wire, such as 0.125 inch gauge steel wire. In particular, it may be preferred that the wire have a square cross-section to facilitate welding of the wire to the tubular rod member.

In the preferred case each of the tubular rod members 78A, 78B, 78C has a latch bar assembly generally indicated by the character 84 mounted adjacent to the first end thereof (i.e., the end from which projects the pin 82). The latch bar assembly 84 includes a fulcrum 84F welded or otherwise attached on a portion of the surface of the member facing toward the central axis 20A of the extender piece 20. An elongated latch bar 84B is pivotally mounted to the fulcrum 84F by a pivot pin 84V. The latch bar 84B is pivotally movable in the direction of the arrow 84W toward the central axis 20A against the restoring force of a leaf spring 84L. The leaf spring 84L is mounted on the exposed facing surface of the latch bar (i.e., the surface facing toward from the central axis 20A). The trailing axial end of the latch bar 84B is cut away, as at 84S, to accommodate the pivotal motion of the bar 84B with respect to the tubular rod member 78 to which it is attached. The nose portion 84N disposed at the forward axial end of the latch bar 84B has an inclined cam surface 84M leading to a planar landing 84P. Formed in the undersurface 84U of the latch bar 84B (i.e., the surface facing away from the central axis 20A) at a location axially behind the planar landing 84P is a blind latch recess opening 84R. An attachment clip 84C is attached to the facing surface of the latch bar 84B in the vicinity of the nose 84N by screws 84T.

Next adjacent to the opposite end of each of the tubular rod members 78A, 78B, 78C is a catch 86. The catch 86 has an inclined cam surface 86M formed between a leading edge 86L and a trailing edge 86T. It should be noted that the pin 82 need not necessarily be disposed at the same end of the extender piece 20 at which is mounted the latch bar 84B, but may project from the end at which the catch 86 is mounted. However, placing the pin 82 proximal to the latch bar 84B affords a measure of mutual protection for these elements.

FIG. 8 illustrates a release membrane 90 useful to impose an opening force simultaneously on each of the latch bars 84B to release the same from latched engagement, as will be developed. The release membrane 90 is formed into a trilobal configuration having a central core region 90C from which emanates a plurality of radially extending fingers 90F. The free end of each of the fingers 90F is connected into the attachment clip 84C of the latch bar 84B. The release membrane 90 is fabricated from a strong, resilient material, such as the polyester film manufactured by E. I. du Pont de Nemours and Company and sold under the trademark MYLAR®.

FIGS. 9A through 9E illustrate the effectuation of a latched interconnection between a latch bar assembly 84 attached to a first member (such as, a first fixed length extender piece 20), and a catch 86 attached to a second member (such as, a second fixed length extender piece 20'). As should become readily apparent the latching action to be described between the latch bar assembly 84 and the catch 86 will be the same whatever the particular members carrying these elements.

Figure 9A:
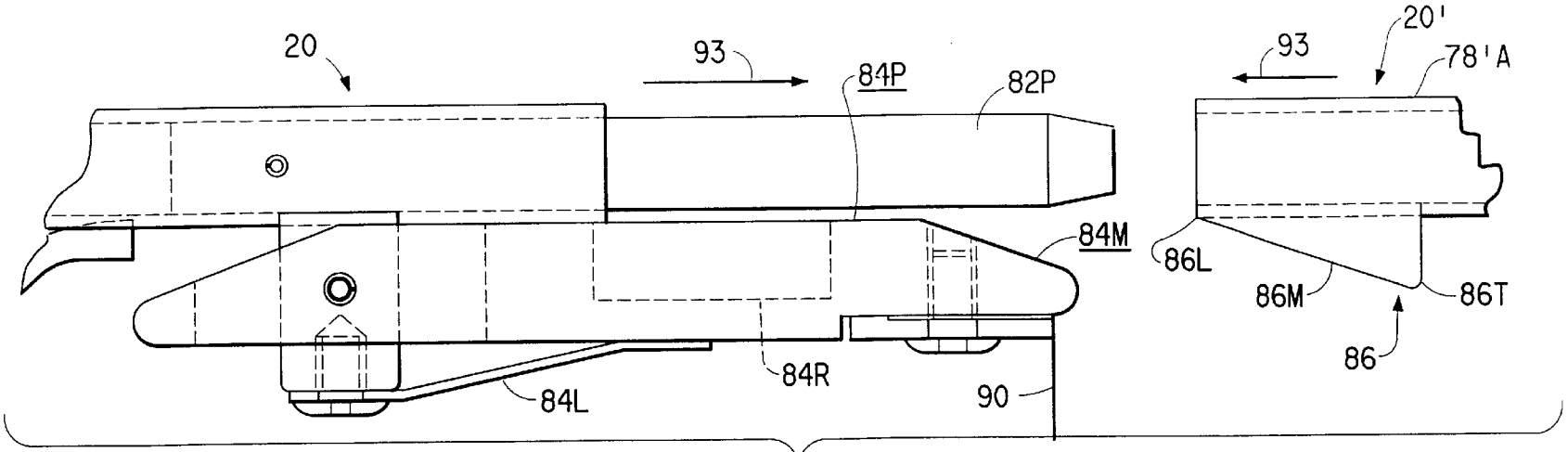
FIGS. 9A through 9E are side elevation views progressively illustrating the latching engagement of a latch arrangement whereby a first extender piece (e.g., the fixed length extender piece of FIG. 7) is interconnected with another extender piece or with another element of the extension arrangement in accordance with the present invention.
Figure 9B:
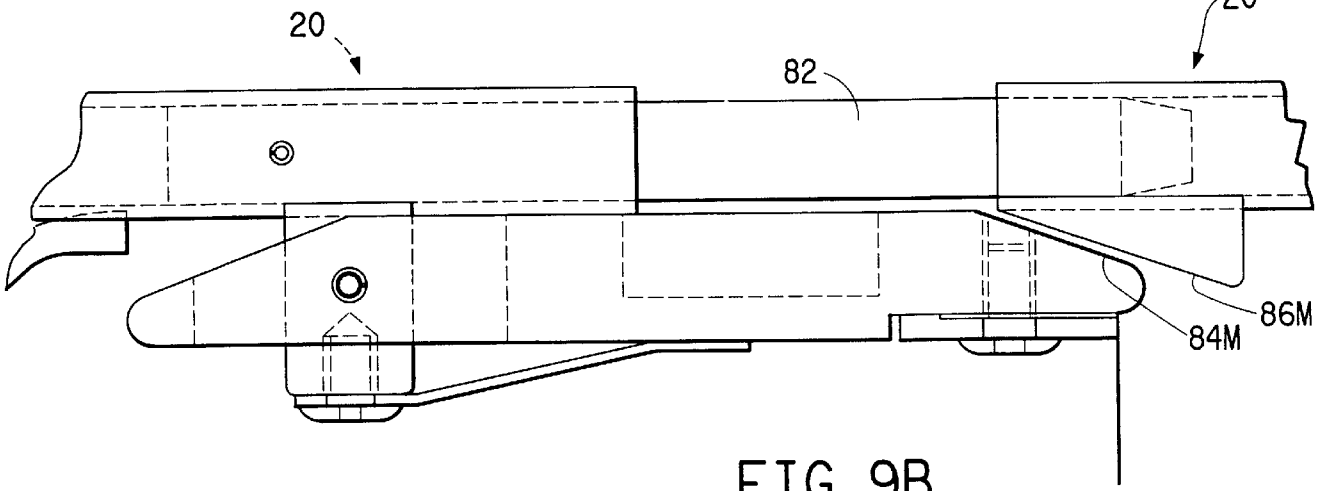
Figure 9C:
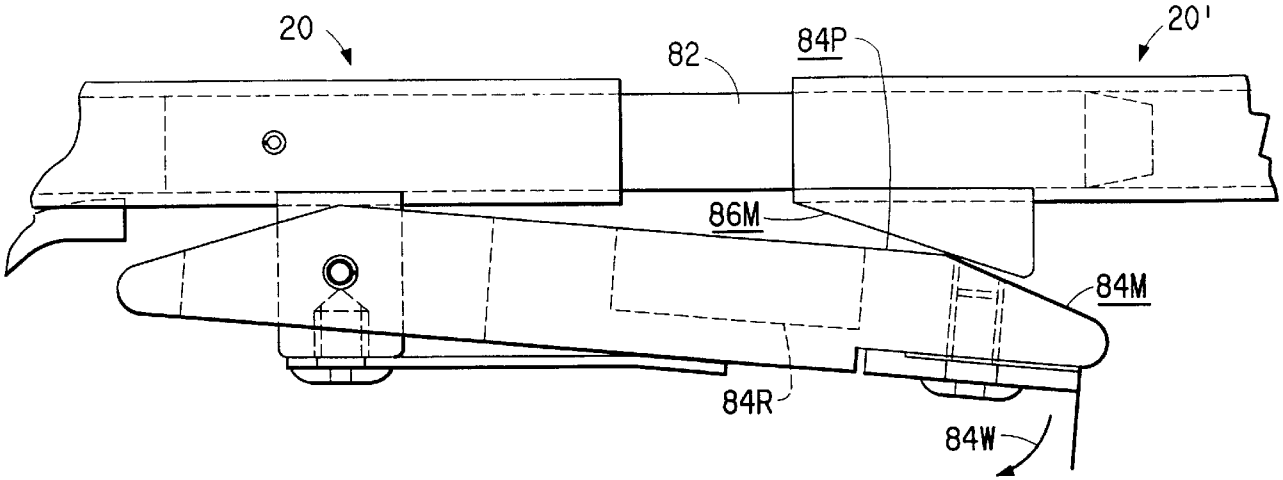
Figure 9D:
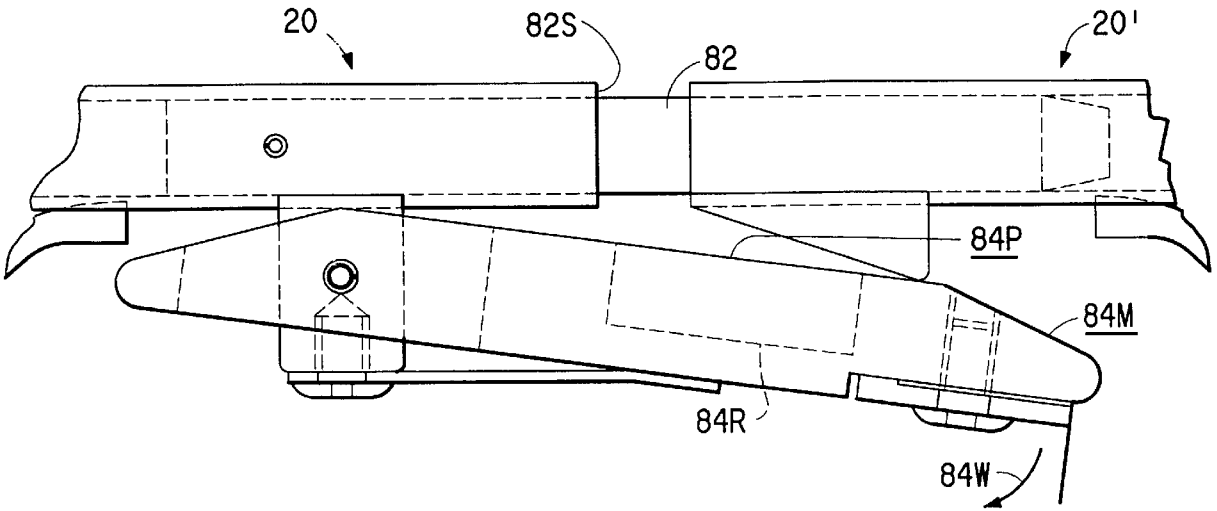
Figure 9E:
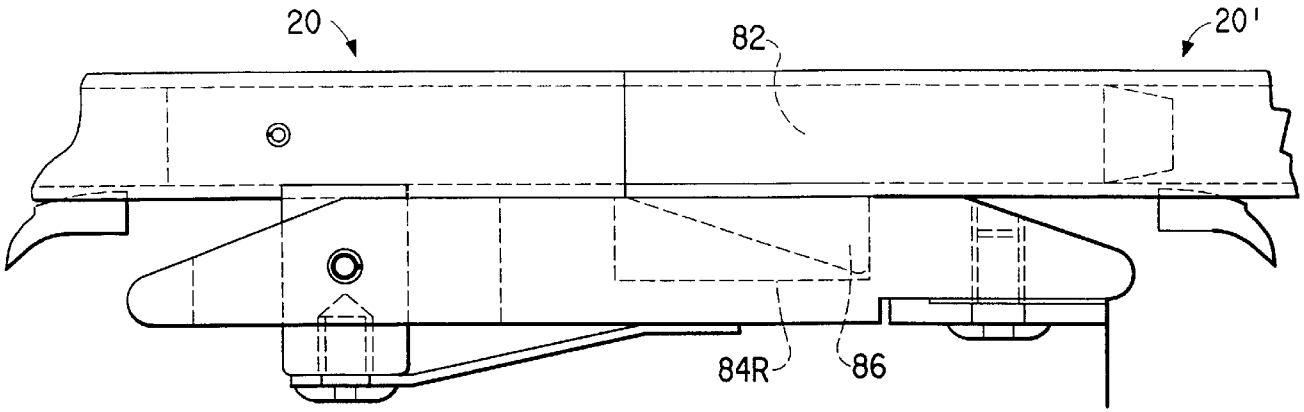

As may be understood from FIG. 9A as the members 20, 20' are advanced toward each other in the closing direction 93 (parallel to the axes 20A, 20'A of the members) the pins 82P projecting from the first end of the tubular rod members of the first member 20 are received into the tubular rod members of the second member 20'. The predetermined distance 82D (FIG. 7) is sized to permit this action to first occur. In FIG. 9B is depicted the relative disposition of the parts just before the inclined cam surface 86M formed on the catch 86 engages with the cam surface 84M on the latch bar 84. From FIG. 9C it may be discerned that as the surfaces 84M, 86M engage the latch bar 84 is caused to pivot in the direction 84W. FIG. 9D shows that the latch bar 84B continues to pivot as the surface 86H slides across the planar landing 84P. In FIG. 9E, when the trailing edge 86T of the cam surface 84M clears the landing 84P, the latch bar snaps to its closed position, capturing the latch catch in the recess 84R. The members 20, 20' may continue to move slightly relative to each other until the end face of each tubular rod members forming the member 20' bottoms against the annular shoulder 82S on the corresponding member 20. It is important to note that the recess 84R on each of the latch bars 84B should be positioned the same distance from the respective nose end thereof, such that the latch bars 84B snap to their closed positions substantially simultaneously.

Figure 9F:
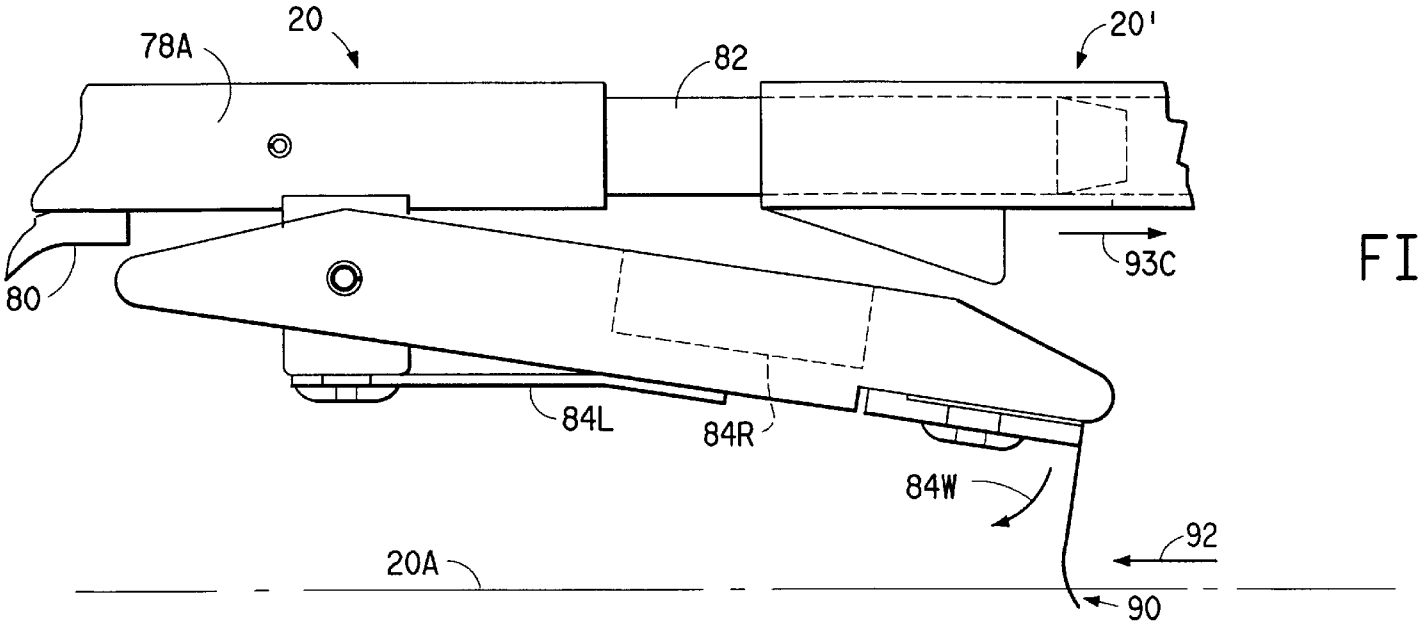
FIG. 9F is a side elevation view illustrating the utilization of a release membrane for releasing a latching engagement between members, one of which includes a latch arrangement as shown in FIGS. 7 through 9E.

With reference to FIG. 9F the release of the latched members 20, 20' using the release membrane 90 is illustrated. An opening force 92 acting in the direction of the axis 20A of the member 20 is asserted against the central core region 90C, causing the membrane 90 to deflect. In response, each of the latch bars 84B pivots in the direction 84W to release the catch 86 from the latch recess 84R, permitting the second member 20' to be withdrawn axially from the member 20, in the direction 93C (counter to the closing direction 93).

It should be apparent from the foregoing that any required number of fixed length extender pieces 20 may be axially interconnected to each other to increase the span of the extension arrangement 16.

Adjustable Extender Piece

Figure 10:
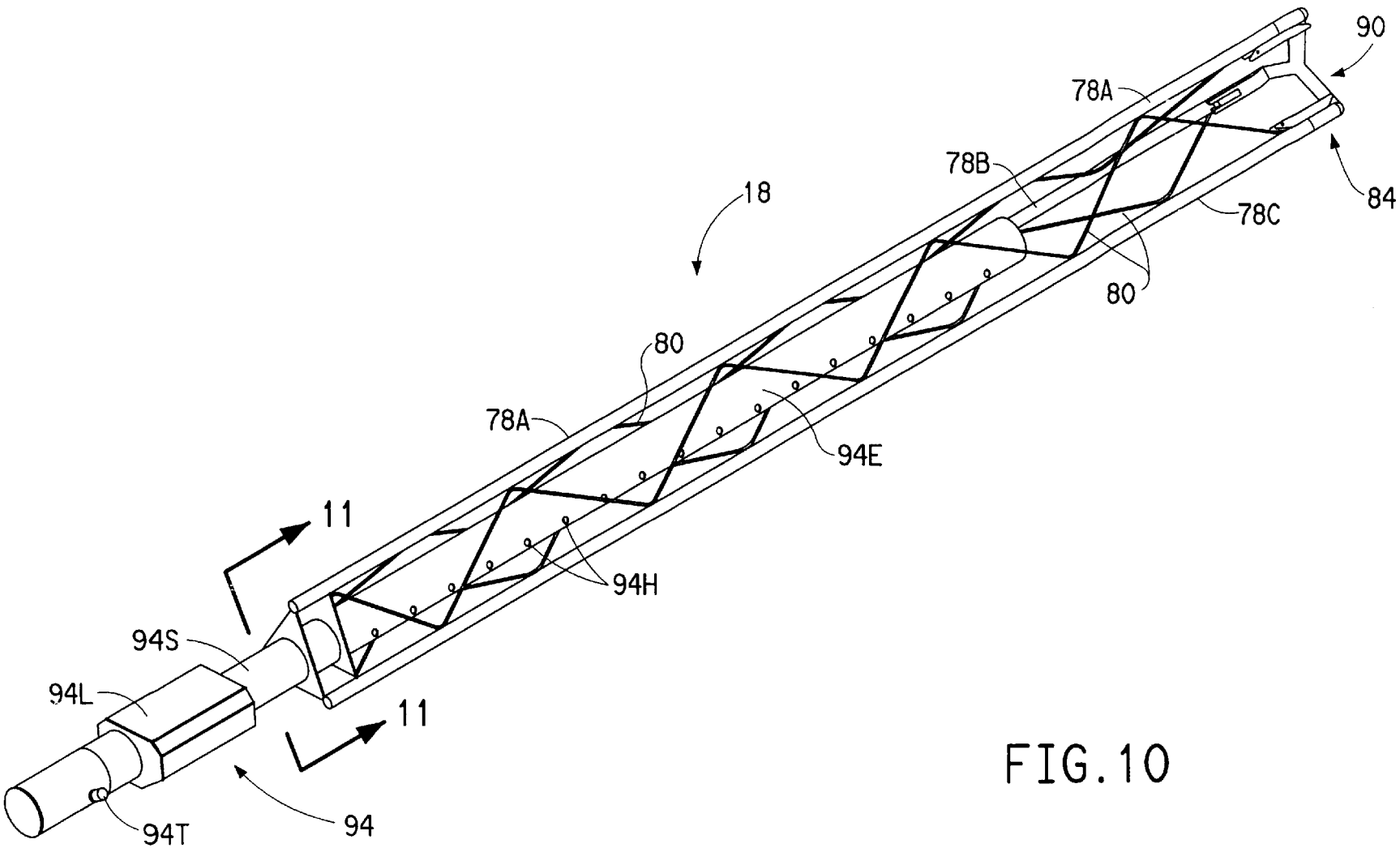
FIG. 10 is an isolated front perspective view of an adjustable extender piece used in connection with the stretching apparatus in accordance with the present invention.
Figure 12:
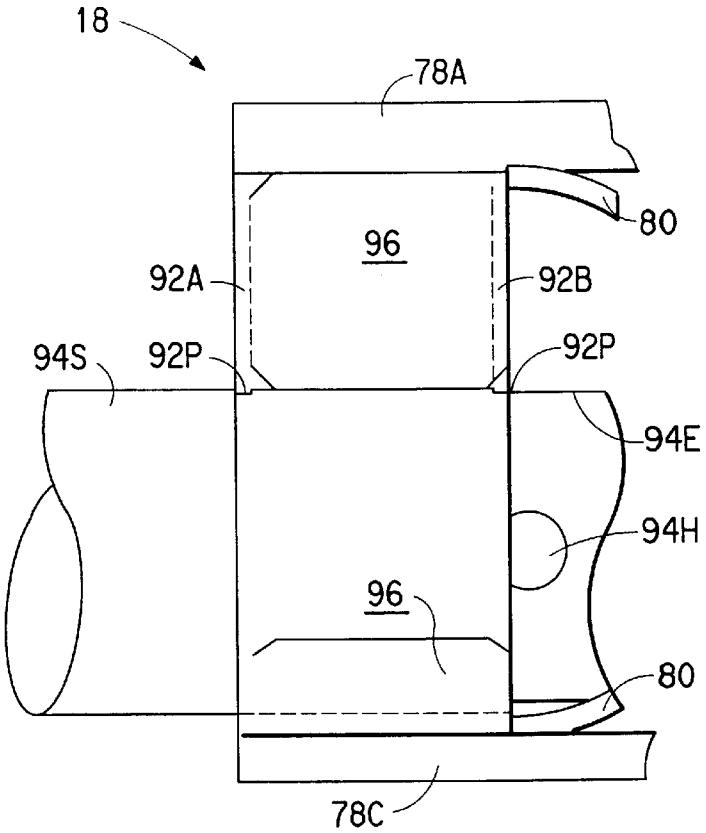
FIG. 12 is a side elevational view of the mounting of the variable length extension tube.
Figure 11:
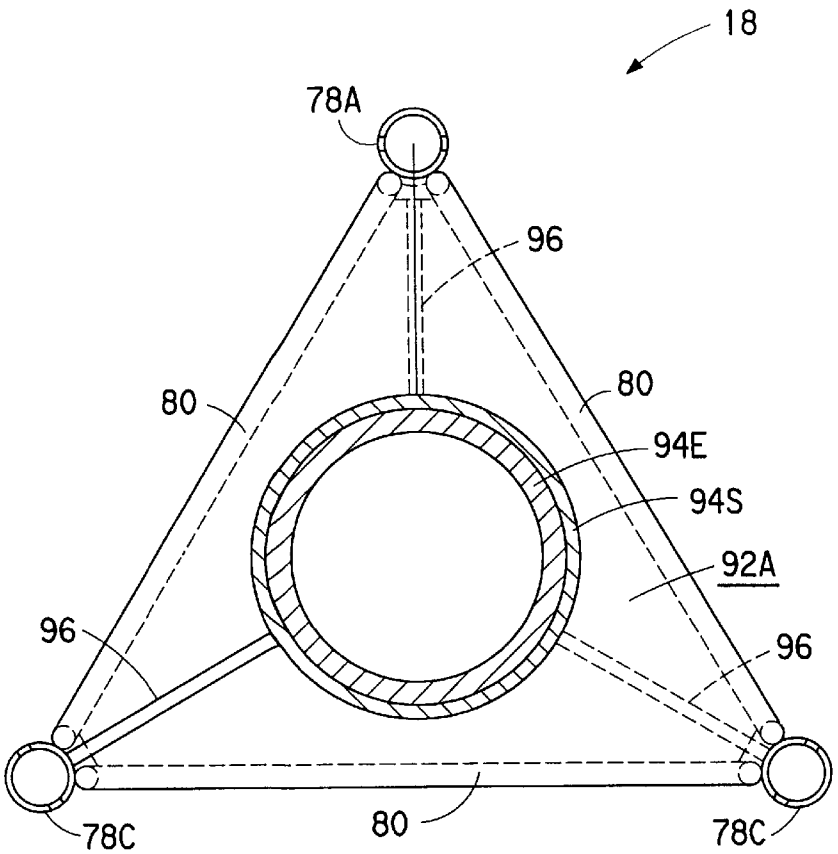
FIG. 11 is a front section view taken along section lines 11—11 in FIG. 10 illustrating the mounting of the variable length extension tube into the adjustable extender piece of FIG. 10.

An adjustable extender piece 18 is illustrated in FIGS. 10 through 12. The adjustable extender piece 18 is similar to the fixed length extender piece 20 in that it also comprises a truss structure formed from at least three tubular rod members 78A, 78B, 78C rigidly connected by wire struts 80, as described above. As seen in the isolated perspective view of FIG. 10 a first end of the extender piece 20 includes the latch bar assembly 84 also as described above.

At the opposite end the extender piece 20 the tubular rods members 78A, 78B, 78C are interconnected by a spaced pair of support plates 92A, 92B. Each of the support plates 92A, 92B has a central axial opening 92P therein. The support plates 92A, 92B carry a variable length extension tube arrangement generally indicated at 94. The variable length extension arrangement 94 comprises an outer support tube 94S within which an inner, elongated extension tube 94E is disposed in close-fitting slidable relationship. The elongated extension tube 94E has a detent latch 94T provided at the free outer end thereof and a series of apertures 94H disposed therealong. The outer support tube 94S extends through the aligned openings 92P in the support plates 92A, 92B and is braced in position by radial webs 96. The webs 96 extend between each of the tubular rod members 78 and the support tube 94S.

The inner, elongated extension tube 94E is telescopically received on the interior of the truss structure of the extender piece 20. The extension tube 94E is secured relative to the outer support tube 94S at any one of the predetermined plurality of axial locations along the extension tube by a locking mechanism 94L. (FIG. 10). The locking mechanism 94L serves to adjustably secure the inner elongated extension tube 94E with respect to the outer support tube 94S. Depending upon the location at which the extension tube 94E is locked to the outer support tube 94S by the locking mechanism 94L the extension tube 94E extends axially beyond the free end of the support tube 94S. Thus, the effective overall axial length of the extender piece 20 (defined between the first end of the extender piece and the free end of the elongated extension tube 94E) is adjustable to any one of a predetermined plurality of distances. The variable length extension arrangement 94 is preferably implemented using the accessory device sold Crain Cutter Company, Milpitas, Calif., as catalog number 501. The details of this device, and particularly the locking mechanism thereof, are believed to be described in U.S. Pat. No. 4,934,568 (Berg et al.).

To whatever the length the extension arrangement 94 is adjusted, the detent 94T at the free end of the extension tube 94E engages in the detent opening 32P in the collar 32 (FIG. 3), thereby to interconnect the variable length extender piece 18 to the stretching apparatus 12. The diameter of the extension tube 94E is selected such that it is smaller than the diameter of the collar 32 and is larger than the diameter of the boom 42.

It should be appreciated from the foregoing that, depending upon the distance to be spanned between the stretching apparatus 12 and the anchor arrangement 14 (however provided) the adjustable extender piece 20 may be used alone, or in conjunction with one of more fixed length extender pieces. (Of course, it should be recognized that instances may occur in which the span may be bridged using one or more of the fixed length extender pieces 10, without the necessity of an adjustable extender 18.)

Adapter

Figure 13:
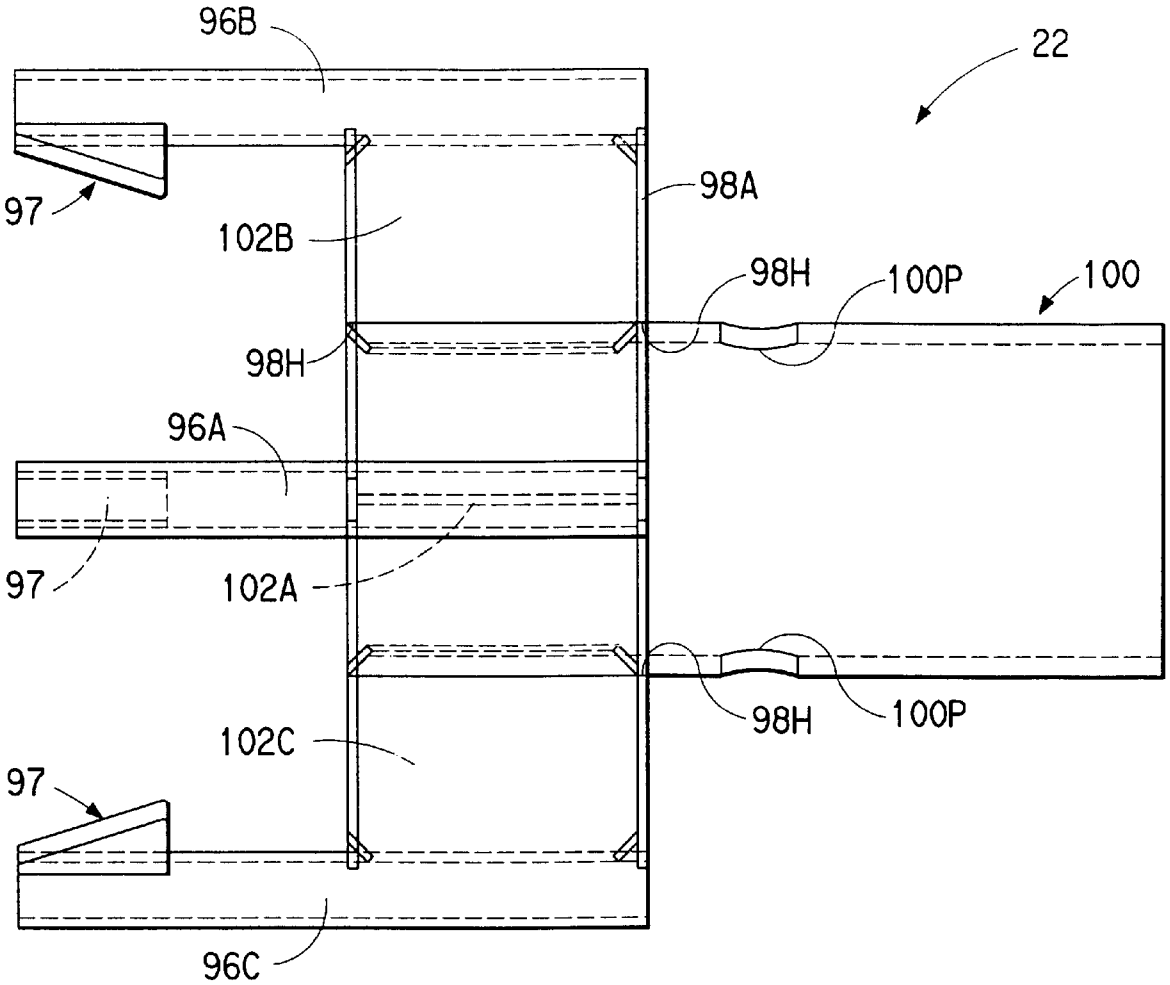

The adapter 22 for joining the extension arrangement 16 to the anchor arrangement is illustrated in FIG. 13. The adapter 22 is formed of at least three tubular stub rod members 96A, 9GB, 96C that are rigidly connected by a spaced pair of support plates 98A, 98B. The support plates 98A, 98B have aligned axial openings 98H formed therein. A relatively short length of tube 100 extends through the openings in the support plates, and is braced by brace plates 102A, 102B, 102C that extend between the stub rods 96A, 96B, 96C and the tube 100. The free end of the tube 100 has a pair of detent openings 100P therein. The detent openings 100P accepts a detent latch of an anchor arrangement to be described. Each of the rod members 96A, 9GB and 96C has catches 97 (identical to the catches 86, FIG. 7) to enable the adapter 22 to latch with the latch bar assembly 84 on the end of the extender piece 20.

It should be understood that various modifications to the extension arrangement hereinbefore described could be effected without departing from the scope of the present invention. As examples of such modifications, the truss structure can be formed from more than three tubular rod members. Alternatively or additionally, the axial ends of the extender piece on which the latch bar or the catch is disposed may be reversed.

Anchor Arrangement

As mentioned earlier the stretching apparatus 12 must be anchored so that the stretching force generated by the stretching apparatus 12 may be imparted into the carpet C. To this end the anchor arrangement 14 is provided to form a reactive backstop against which the stretching apparatus 12 may be braced.

The anchor arrangement 14 may be implemented using any commercially available tail block assembly or any known gripping cleat, assuming that it presents or is modifiable to present a compatible detent latch so as to interconnect with the detent openings 100P in the free end of the tube 100 of the adapter 22. Representative of one such commercially available device is the tail block assembly sold by Crain Cutter Company, Milpitas, Calif., as model 1500-W. The construction of a "dead man" gripping cleat as used in the prior art has been described earlier.

Figure 14A:
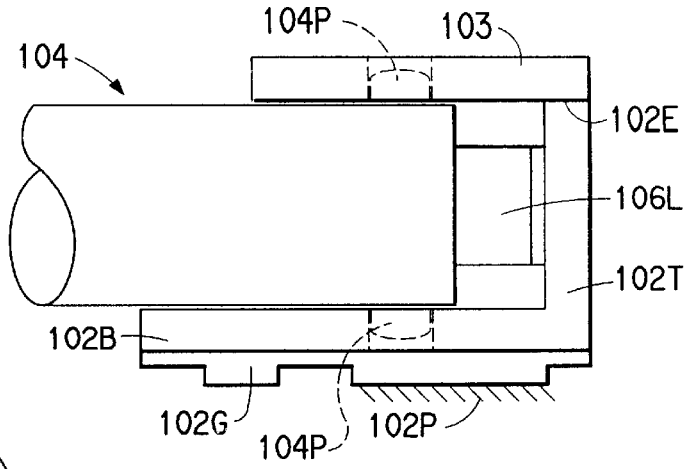
FIG. 14A is a side elevational view of the anchor arrangement of FIG. 14.
Figure 14:
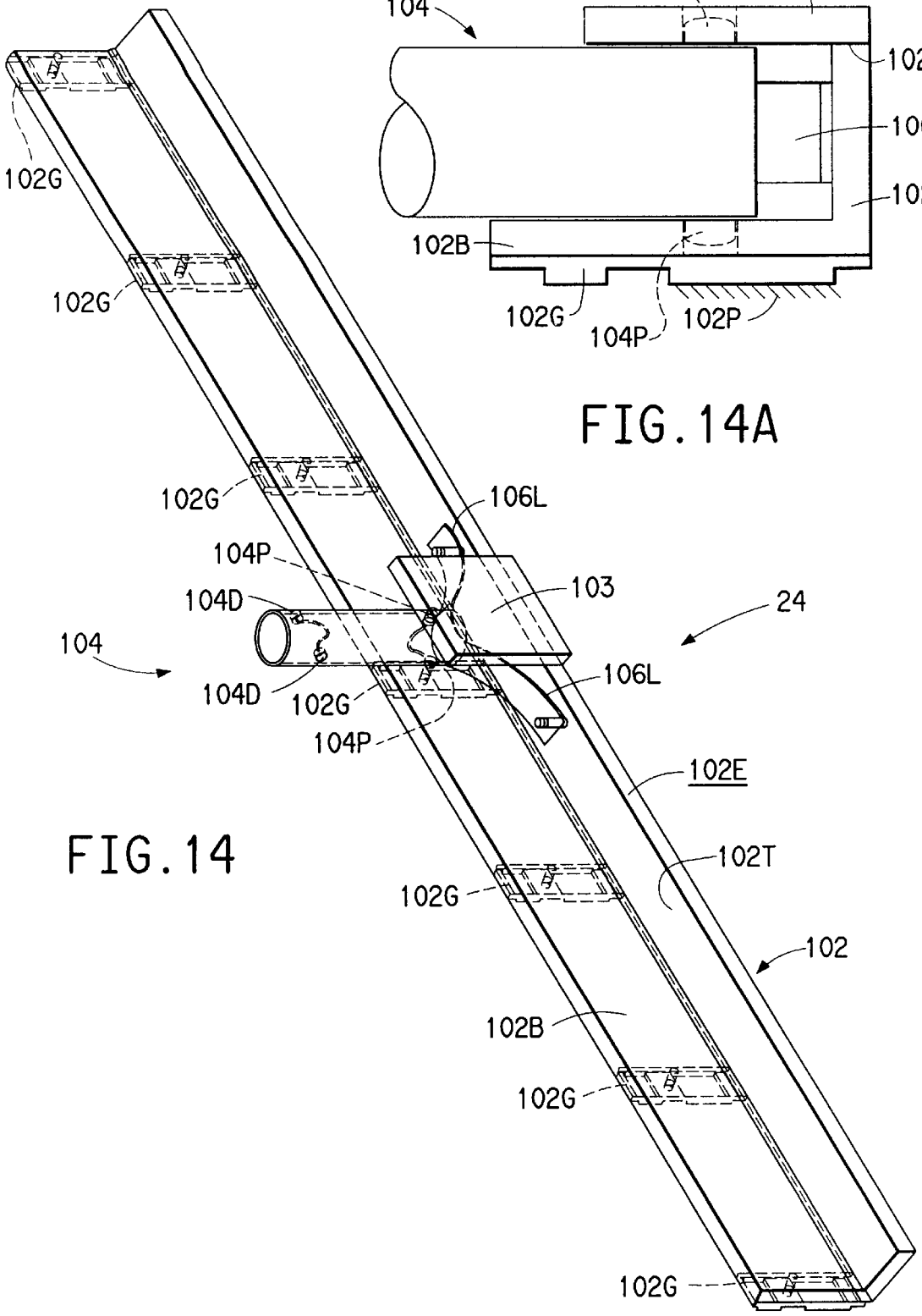

Instead of the "dead man" gripping cleat, FIG. 14 illustrates a perspective view of an alternative form of anchor arrangement 24 useful with the stretching apparatus and extension arrangement of the present invention. The anchor 24 shown in FIGS. 14 and 14A takes the form of a gripping cleat that engages the carpet C behind the stretching apparatus 12. The gripping cleat 24 defines a suitable reaction surface against which the stretching apparatus 12 is braced, such that the displacement of the gripping head 48 will impose the stretching force generated thereby into the carpet C.

The gripping cleat 24 is a generally L-shaped member 102 in which one leg defines a base 102B while the other leg forms an upright backstop 102T. The underside 102U of the base 102B has a plurality of gripping strips 102G. The gripping strips each 102G have gripping pins 102P that are engageable with the carpet C. As is best seen in FIG. 14A, the gripping pins 102P incline with respect to the base 102B in a direction toward the backstop 102T. Suitable for use as the gripping heads is the "Gripper Inserts" sold by Crain Cutter Company, Milpitas, Calif., model 1505-K.

A cover plate 103 is attached to the upper edge 102E of the upright 102T. A tubular connector 104 is pivotally engaged between the cover plate 103 and the base 102B on a pair of spring loaded pins 104P. A respective one of the pins 104P engages with an opening formed for this purpose in the base 102B while the other one of the pins 104P engages with the opening in the cover 103, respectively. It may be desirable to utilize a single axle pin to connect the cover plate 103, the connector 102T and the base 102B.

The connector 104 also has a pair of spring-loaded detent pins 104D adjacent its forward end. The detent pins 104D in the tubular connector 104 are engageable with the openings 100P in the adapter 100, thereby to interconnect the adapter 22 to the anchor 24.

The end of the connector 104 is spaced a clearance distance forward of the backstop 102T. A bias arrangement, in the form of a leaf spring 106L, is disposed between the end of the tubular connector 104 and the backstop 102T. The bias arrangement serves to bias the tubular connector 104 into perpendicularity with respect to the inside face 102F of the upright 102T.

As noted earlier, the gripping cleat available in the prior art (the "dead man") had a tendency to roll from its engagement with the carpet, requiring that another operator stand on the "dead man" and hold it in place during use. It has been found that this tendency occurs because force generated by the stretching apparatus is applied to the "dead man" forwardly of the gripping pins.

In accordance with the present invention the tendency to roll is cured by having any forces 108 generated by the displacement of the gripping head 48 of the stretching apparatus 12 imposed into the upright backstop 102T, via the pinned engagement of the connector 104T to plate 103 and the base 102B. The connector 104 is connected to the L-shaped member 102 in a such way that pivotal motion of the connector 104 with respect to the backstop in a plane perpendicular to the plane of the carpet is prevented from occurring. By imposing forces from the stretching apparatus into the backstop 102T at a point of application substantially rearwardly (in the direction of inclination of the gripping pins 102P) of the pins 102P, the pins 102P are drawn into the carpet C and the tendency of the gripping pins 102P to roll from the carpet is reduced.

Those skilled in the art, having the benefit of the teachings of the present invention as set forth herein, may effect numerous modifications thereto. Such modifications are to be construed as lying within the contemplation of the present invention, as defined by the appended claims.

What is claimed is:

1. An extension system for use with a carpet stretching apparatus, the extension system comprising:

an extender piece connectable to the carpet stretching apparatus, the extender piece having at least three tubular rod members rigidly connected to each other by struts to form a truss structure wherein at least one of the tubular rod members lies outside of a plane containing the other two tubular rod members, the truss structure having an axis therethrough, the struts connecting any two of the tubular rod members lying substantially in a plane containing the two tubular rod members, the tubular rod members being spaced radially from the axis, the tubular rod members being disposed in parallel relationship to each other and to the axis, and wherein the extender piece has a first and a second end thereon, an outer support tube supported in substantially rigid relationship from the tubular rod members adjacent to the first end of the extender piece, an elongated inner tube slidably disposed within the outer support tube in a direction parallel to the axis of the truss structure, the elongated inner tube having a free end and an inner end. The elongated inner tube being telescopically receivable within the truss structure, the elongated inner tube being securable in fixed relationship to the outer support tube at any of a predetermined plurality axial locations along the elongated inner tube thereby to adjust the distance from the free end of the elongated inner tube to the second end of the extender piece.

2. The carpet stretching apparatus of claim 1 wherein a first end of each of the tubular rod members forming the extender piece having a latch recess formed therein, and a second end each of the tubular rod members forming the extender piece having a catch, the catch having an inclined cam surface thereon.

3. The extension system of claim 2 wherein each of the tubular members forming the extender piece has a latch bar pivotally mounted thereon, the latch bar having the latch recess therein.

4. The extension system of claim 3 further comprising a release membrane connected to each of the latch bars, displacement of the release membrane causing each of the latch bars substantially simultaneously to displace pivotally with respect to the tubular rod member to which the latch bar is mounted.

5. An extension system for use with a carpet stretching apparatus, the extension system comprising:

a first extender piece and a second extender piece, each of the extender pieces having an axis extending therethrough, one of the extender pieces being connectible to a carpet stretching apparatus, each extender piece comprising at least three tubular members rigidly connected to each other by braces to form a truss structure, the braces connecting any two of the tubular members lying substantially in a plane containing the two tubular members, the tubular members in each extender piece being spaced radially from the axis, the tubular members being disposed in parallel relationship to each other and to the axis, a first end of each of the tubular members forming the first extender piece having a latch recess formed therein, and a second end each of the tubular members forming the second extender piece having a catch thereon, the catches being insertable into latch recesses to hold the first extender piece in latched engagement with the second extender piece.

6. The carpet stretching apparatus of claim 5 wherein the first extender piece has a first and a second end thereon, an outer support tube supported in substantially rigid relationship from the tubular rod members adjacent to the first end of the first extender piece, an elongated inner tube slidably disposed within the outer support tube in a direction parallel to the axis of the truss structure, the elongated inner tube having a free end and an inner end, the elongated inner tube being telescopically receivable within the truss structure, the elongated inner tube being securable in fixed relationship to the outer support tube at any of a predetermined plurality axial locations along the elongated inner tube thereby to adjust the distance from the free end of the elongated inner tube to the second end of the first extender piece.

7. The extension system of claim 5 wherein each of the tubular rod members forming the first extender piece has a latch bar pivotally mounted thereon, the latch bar having the latch recess therein.

8. The extension system of claim 7 wherein each of the tubular members forming one of the extender pieces has an alignment pin extending therefrom, the alignment pin being disposed at the same end of the tubular member as is the latch bar.

9. The extension system of claim 7 further comprising a release membrane connected to each of the latch bars, displacement of the release membrane causing each of the latch bars substantially simultaneously to displace pivotally with respect to the tubular rod member to which the latch bar is mounted.

10. The extension system of claim 5 wherein the recess in each of the tubular rod members forming the first extender piece lies the same predetermined distance from the end of the first extender piece such that the catches on each tubular member forming the second extender piece enter into latched engagement with the recesses at substantially the same time.

11. The extension system of claim 5 wherein each of the tubular members forming one of the extender pieces has an alignment pin extending therefrom.

* * * * *